US008972249B2

(12) United States Patent
Suzuki et al.

(10) Patent No.: US 8,972,249 B2
(45) Date of Patent: Mar. 3, 2015

(54) DECODING APPARATUS AND METHOD, ENCODING APPARATUS AND METHOD, AND PROGRAM

(75) Inventors: Shiro Suzuki, Kanagawa (JP); Yuuki Matsumura, Saitama (JP); Jun Matsumoto, Kanagawa (JP); Yuuji Maeda, Tokyo (JP); Yasuhiro Toguri, Kanagawa (JP)

(73) Assignee: Sony Corporation, Tokyo (JP)

( * ) Notice: Subject to any disclaimer, the term of this patent is extended or adjusted under 35 U.S.C. 154(b) by 340 days.

(21) Appl. No.: 13/634,658

(22) PCT Filed: Mar. 15, 2011

(86) PCT No.: PCT/JP2011/056108

§ 371 (c)(1),
(2), (4) Date: Sep. 13, 2012

(87) PCT Pub. No.: WO2011/125430

PCT Pub. Date: Oct. 13, 2011

(65) Prior Publication Data

US 2013/0013325 A1 Jan. 10, 2013

(30) Foreign Application Priority Data

Mar. 31, 2010 (JP) ..... P2010-080515

(51) Int. Cl.
*G10L 19/02* (2013.01)
*G10L 21/038* (2013.01)

(52) U.S. Cl.
CPC ..... *G10L 21/038* (2013.01); *G10L 19/0212* (2013.01)
USPC ..... 704/219

(58) Field of Classification Search
USPC ..... 704/200–230
See application file for complete search history.

(56) References Cited

U.S. PATENT DOCUMENTS 5,819,212 A * 10/1998 Matsumoto et al. ..... 704/219
2010/0017197 A1* 1/2010 Oshikiri ..... 704/205

FOREIGN PATENT DOCUMENTS

JP 61-168000 7/1986
JP 7-234697 9/1995
JP 2004-80635 3/2004

(Continued)

OTHER PUBLICATIONS

English-language International Search Report from the Japanese Patent Office mailed Jun. 28, 2011, for International Application No. PCT/JP2011/056108.

*Primary Examiner* — Abul Azad
(74) *Attorney, Agent, or Firm* — Finnegan, Henderson, Farabow, Garrett & Dunner, LLP

(57) ABSTRACT

The present invention relates to a decoding apparatus, a decoding method, an encoding apparatus, an encoding method, and programs that can shorten the delay time caused by the band extension at the time of decoding, and restrain increases in resources on the decoding side.

A higher frequency component generating unit (73) generates a pseudo higher frequency spectrum by using a lower frequency spectrum (SP-L) and a higher frequency envelope (ENV-H). A phase randomizing unit (74) randomizes the phase of the pseudo higher frequency spectrum, based on a random flag (RND). An inverse MDCT unit (75) denormalizes the lower frequency spectrum (SP-L) by using a lower frequency envelope (ENV-L), and combines the pseudo higher frequency spectrum supplied from the phase randomizing unit (74) with the denormalized lower frequency spectrum (SP-L). The combination result is used as the spectrum of the entire band. The present invention can be applied to a decoding apparatus that performs band extension decoding, for example.

14 Claims, 20 Drawing Sheets

(56) References Cited

FOREIGN PATENT DOCUMENTS

| | | |
|---|---|---|
| JP | 3646938 | 2/2005 |
| JP | 3646939 | 2/2005 |
| JP | 3861770 | 10/2006 |
| JP | 2007-171954 | 7/2007 |

* cited by examiner

DECODING APPARATUS AND METHOD, ENCODING APPARATUS AND METHOD, AND PROGRAM

TECHNICAL FIELD

The present invention relates to a decoding apparatus, a decoding method, an encoding apparatus, an encoding method, and a program. More particularly, the present invention relates to a decoding apparatus, a decoding method, an encoding apparatus, an encoding method, and a program that can shorten the delay time caused by the band extension at the time of decoding, and restrain increases in resources on the decoding side.

BACKGROUND ART

As audio signal encoding techniques, the following transform coding techniques have been generally well known: MP3 (Moving Picture Experts Group Audio Layer-3), AAC (Advanced Audio Coding), and ATRAC (Adaptive Transform Acoustic Coding).

In such an encoding technique, results of encoding do not include a higher frequency spectrum containing a large amount of information, but include only the envelope of the higher frequency spectrum, so as to achieve a higher encoding efficiency. At the time of decoding in such a case, a lower frequency spectrum is duplicated by parallel translation, replication, or the like, to generate a higher frequency spectrum. Only the envelope of the generated higher frequency spectrum is made closer to the envelope of the original higher frequency spectrum contained in the results of encoding, to improve auditory quality. Such a decoding technique is called a band extension technique, and has been already known to the general public.

FIG. 1 is a block diagram showing an example structure of an encoding apparatus that has only the envelope of the higher frequency spectrum in the results of encoding.

The encoding apparatus 10 of FIG. 1 includes a MDCT (Modified Discrete Cosine Transform) unit 11, a quantizing unit 12, and a multiplexing unit 13. The encoding apparatus 10 is the same as a generally known transform coding apparatus, except that a higher frequency spectrum SP-H is not included in the results of encoding. For ease of explanation of the drawings, the quantizing unit 12 not only performs quantization but also extracts and normalizes objects to be quantized.

Specifically, the MDCT unit 11 of the encoding apparatus 10 performs a MDCT on a PCM (Pulse Code Modulation) signal that is an audio time-domain signal that is input to the encoding apparatus 10. By doing so, the MDCT unit 11 generates a spectrum SP that is a frequency domain signal. The MDCT unit 11 supplies the generated spectrum SP to the quantizing unit 12.

The quantizing unit 12 extracts envelopes from the higher frequency spectrum SP-H that is the higher frequency components of the spectrum SP supplied from the MDCT unit 11, and from a lower frequency spectrum SP-L that is the lower frequency components of the spectrum SP. The quantizing unit 12 quantizes a higher frequency envelope ENV-H that is the extracted envelope of the higher frequency spectrum SP-H, and a lower frequency envelope ENV-L that is the extracted envelope of the lower frequency spectrum SP-L. The quantizing unit 12 supplies the quantized higher frequency envelope ENV-H and lower frequency envelope ENV-L to the multiplexing unit 13. In this specification, the names (such as SP-L and SP-H) of signals are the same before and after quantization and encoding, for ease of explanation.

The quantizing unit 12 normalizes the lower frequency spectrum SP-L, using the lower frequency envelope ENV-L. The quantizing unit 12 quantizes the normalized lower frequency spectrum SP-L, and supplies the resultant lower frequency spectrum SP-L to the multiplexing unit 13.

As described above, the quantizing unit 12 has the envelope and the normalized spectrum included in the results of encoding of the lower frequency components of the spectrum SP, but has only the envelope included in the results of encoding of the higher frequency components. Accordingly, the encoding efficiency becomes higher.

The multiplexing unit 13 multiplexes the lower frequency envelope ENV-L, the lower frequency spectrum SP-L, and the higher frequency envelope ENV-H, which are supplied from the quantizing unit 12. The multiplexing unit 13 outputs the resultant bit stream. This bit stream is recorded on a recording medium (not shown), or is transferred to a decoding apparatus.

FIG. 2 is a flowchart for explaining an encoding operation to be performed by the encoding apparatus 10 of FIG. 1. This encoding operation is started when an audio PCM signal is input to the encoding apparatus 10, for example.

In step S11 of FIG. 2, the MDCT unit 11 performs a MDCT on a PCM signal that is an audio time-domain signal that is input to the encoding apparatus 10, and generates the spectrum SP that is a frequency domain signal. The MDCT unit 11 supplies the generated spectrum SP to the quantizing unit 12.

In step S12, the quantizing unit 12 extracts envelopes from the higher frequency spectrum SP-H that is the higher frequency components of the spectrum SP supplied from the MDCT unit 11, and from the lower frequency spectrum SP-L that is the lower frequency components of the spectrum SP.

In step S13, the quantizing unit 12 normalizes the lower frequency spectrum SP-L, using the lower frequency envelope ENV-L.

In step S14, the quantizing unit 12 performs quantization on the extracted higher frequency envelope ENV-H, lower frequency envelope ENV-L, and on the normalized lower frequency spectrum SP-L. The quantizing unit 12 supplies the quantized higher frequency envelope ENV-H, lower frequency envelope ENV-L, and the normalized lower frequency spectrum SP-L to the multiplexing unit 13.

In step S15, the multiplexing unit 13 multiplexes the lower frequency envelope ENV-L, the lower frequency spectrum SP-L, and the higher frequency envelope ENV-H, which are supplied from the quantizing unit 12. The multiplexing unit 13 outputs the resultant bit stream. This operation then comes to an end.

FIG. 3 is a block diagram showing an example structure of a decoding apparatus that decodes bit streams encoded by the encoding apparatus 10 of FIG. 1.

The decoding apparatus 30 of FIG. 3 includes a dividing unit 31, an inverse quantizing unit 32, an inverse MDCT unit 33, and a band extending unit 34.

The dividing unit 31, the inverse quantizing unit 32, and the inverse MDCT unit 33 of the decoding apparatus 30 decodes only the lower frequency components of PCM signals, like a conventional transform decoding apparatus.

Specifically, the dividing unit 31 obtains a bit stream encoded by the encoding apparatus 10, and divides the bit stream into the lower frequency envelope ENV-L, the lower frequency spectrum SP-L, and the higher frequency envelope ENV-H. The dividing unit 31 then supplies the lower frequency envelope ENV-L, the lower frequency spectrum SP-L, and the higher frequency envelope ENV-H to the inverse quantizing unit 32.

The inverse quantizing unit 32 performs inverse quantization on the lower frequency envelope ENV-L, the lower frequency spectrum SP-L, and the higher frequency envelope ENV-H, which are supplied from the dividing unit 31. The inverse quantizing unit 32 then supplies the inversely-quantized lower frequency envelope ENV-L and lower frequency spectrum SP-L to the inverse MDCT unit 33, and supplies the higher frequency envelope ENV-H to the band extending unit 34.

Using the lower frequency envelope ENV-L supplied from the inverse quantizing unit 32, the inverse MDCT unit 33 denormalizes the lower frequency spectrum SP-L. The inverse MDCT unit 33 performs an inverse MDCT on the lower frequency spectrum SP-L, which is a denormalized frequency domain signal, and obtains a PCM signal that is a time domain signal. This PCM signal is a PCM signal not containing higher frequency components, and is a PCM signal of auditorily muffled sound. The inverse MDCT unit 33 supplies the PCM signal to the band extending unit 34.

The band extending unit 34 includes a band dividing filter 41, a higher frequency component generating unit 42, and a band combining filter 43. The band extending unit 34 extends the frequency band of the PCM signal that is obtained by the inverse MDCT unit 33 and does not contain higher frequency components. By doing so, the band extending unit 34 performs a band extending operation to improve the sound quality of the PCM signal.

Specifically, the band dividing filter 41 of the band extending unit 34 divides the PCM signal supplied from the inverse MDCT unit 33 into higher frequency components and lower frequency components. Since this PCM signal does not contain higher frequency components, the band dividing filter 41 discards the higher frequency components of the divided PCM signal. The band dividing filter 41 also supplies a lower frequency PCM signal BS-L, which is the lower frequency components of the divided PCM signal, to the higher frequency component generating unit 42 and the band combining filter 43.

Using the lower frequency PCM signal BS-L supplied from the band dividing filter 41 and the higher frequency envelope ENV-H supplied from the inverse quantizing unit 32, the higher frequency component generating unit 42 generates a higher frequency PCM signal to be a pseudo higher frequency PCM signal BS-H. An example method of generating the pseudo higher frequency PCM signal BS-H is disclosed in Patent Document 1, which was filed by the applicant. The higher frequency component generating unit 42 supplies the pseudo higher frequency PCM signal BS-H to the band combining filter 43.

The band combining filter 43 combines the lower frequency PCM signal BS-L supplied from the band dividing filter 41 with the pseudo higher frequency PCM signal BS-H supplied from the higher frequency component generating unit 42, and outputs an entire-band PCM signal as the results of the decoding.

The sound corresponding to the entire-band PCM signal that is output in the above described manner is less muffled than the sound corresponding to the PCM signal not containing higher frequency components, and is a beautiful and comfortable sound.

FIG. 4 is a diagram for explaining the signals that are output from the inverse MDCT unit 33 and the band combining filter 43. In FIG. 4, the abscissa axis indicates frequency, and the ordinate axis indicates signal level. This also applies to FIGS. 7, 10, and 12 through 16, which will be described later.

The signal that is output from the inverse MDCT unit 33 is the PCM signal of the lower frequency spectrum SP-L denormalized by using the lower frequency envelope ENV-L, as shown in A in FIG. 4. The signal that is output from the band combining filter 43 is a PCM signal that contains lower frequency components as the PCM signal of the lower frequency spectrum SP-L denormalized by using the lower frequency envelope ENV-L, and higher frequency components as the pseudo higher frequency PCM signal BS-H generated from the higher frequency envelope ENV-H and the lower frequency PCM signal BS-L, as shown in B in FIG. 4.

FIG. 5 is a flowchart for explaining a decoding operation to be performed by the decoding apparatus 30 of FIG. 3. This decoding operation is started when a bit stream encoded by the encoding apparatus 10 is input to the decoding apparatus 30, for example.

In step S31 of FIG. 5, the dividing unit 31 divides the bit stream input to the decoding apparatus 30 into the lower frequency envelope ENV-L, the lower frequency spectrum SP-L, and the higher frequency envelope ENV-H. The dividing unit 31 then supplies the lower frequency envelope ENV-L, the lower frequency spectrum SP-L, and the higher frequency envelope ENV-H to the inverse quantizing unit 32.

In step S32, the inverse quantizing unit 32 performs inverse quantization on the lower frequency envelope ENV-L, the lower frequency spectrum SP-L, and the higher frequency envelope ENV-H, which are supplied from the dividing unit 31. The inverse quantizing unit 32 supplies the inversely-quantized lower frequency envelope ENV-L and lower frequency spectrum SP-L to the inverse MDCT unit 33. The inverse quantizing unit 32 supplies the higher frequency envelope ENV-H to the band extending unit 34.

In step S33, the inverse MDCT unit 33 denormalizes the lower frequency spectrum SP-L, using the lower frequency envelope ENV-L supplied from the inverse quantizing unit 32.

In step S34, the inverse MDCT unit 33 performs an inverse MDCT on the lower frequency spectrum SP-L, which is a denormalized frequency domain signal, and obtains a PCM signal that is a time domain signal. The inverse MDCT unit 33 supplies the PCM signal to the band extending unit 34.

In step S35, the band dividing filter 41 of the band extending unit 34 divides the PCM signal supplied from the inverse MDCT unit 33 into higher frequency components and lower frequency components. The band dividing filter 41 discards the higher frequency components of the divided PCM signal, and supplies the lower frequency PCM signal BS-L, which is the lower frequency components of the divided PCM signal, to the higher frequency component generating unit 42 and the band combining filter 43.

In step S36, the higher frequency component generating unit 42 generates the pseudo higher frequency PCM signal BS-H, using the lower frequency PCM signal BS-L supplied from the band dividing filter 41 and the higher frequency envelope ENV-H supplied from the inverse quantizing unit 32. The higher frequency component generating unit 42 supplies the pseudo higher frequency PCM signal BS-H to the band combining filter 43.

In step S37, the band combining filter 43 combines the lower frequency PCM signal BS-L supplied from the band dividing filter 41 with the pseudo higher frequency PCM signal BS-H supplied from the higher frequency component generating unit 42, to obtain the entire-band PCM signal. The band combining filter 43 outputs the entire-band PCM signal, and the operation comes to an end.

The above described band extension technique has been already used in HE-AAC (High-Efficiency Advanced Audio Coding), which is an international standard, and in the stereo high-quality mode of LPEC (trade name).

As described above, by the conventional band extension technique, the band extending operation is performed as the post processing for the decoding of the lower frequency spectrum SP-L. Accordingly, the degree of freedom of the pseudo higher frequency PCM signal BS-H can be made higher. That is, the pseudo higher frequency PCM signal BS-H can be generated not from the lower frequency spectrum SP-L, which is a frequency domain signal, but from the lower frequency PCM signal BS-L, which is a time domain signal.

The processing block sizes in the encoding operation and the decoding operation, and the processing block size in the band extending operation are arbitrarily set, so as to optimize frequency analysis precision and time resolving precision.

In a case where the pseudo higher frequency PCM signal is generated by the technique disclosed in Patent Document 1, complicated procedures need to be carried out to generate a noise spectrum from the higher frequency envelope ENV-H, generate a tonic spectrum from the higher frequency envelope ENV-H and the lower frequency PCM signal BS-L, and compare the two spectrums.

The process of generating the noise spectrum and the tonic spectrum is the necessary process in increasing the matching accuracy between the lower frequency spectrum and the higher frequency spectrum to generate sound with high auditory quality, and is also performed in the decoding apparatuses disclosed in Patent Documents 2 and 3.

CITATION LIST

Patent Documents

Patent Document 1: Japanese Patent No. 3861770
Patent Document 2: Japanese Patent No. 3646938
Patent Document 3: Japanese Patent No. 3646939

SUMMARY OF THE INVENTION

Problems to be Solved by the Invention

As described above, the conventional band extension technique has been studied, developed, and put into practice in such a manner that the band extending operation is performed as the post processing for the decoding of the lower frequency spectrum SP-L. Therefore, the entire-band PCM signal is output after the processing time required by the band extending unit 34 has passed (time T1 in the example illustrated in FIG. 3) from the end of the conventional decoding operation performed by the dividing unit 31, the inverse quantizing unit 32, and the inverse MDCT unit 33 (time T0 in the example illustrated in FIG. 3).

This does not cause a serious problem, if the decoding apparatus 30 is provided in a reproducing apparatus that reproduces only sound. In a case where the decoding apparatus 30 is provided in a reproducing apparatus that reproduces video images in synchronization with sound, however, there is a difference in the output time of the entire-band PCM signal between a case where only the conventional decoding is performed and a case where the band extension is also performed. As a result, outputting video images in synchronization with sound becomes difficult.

To solve this problem, the timing to reproduce video images needs to be delayed. However, video image buffering requires a memory with a larger capacity than that for sound buffering, resulting in an increase in resources. The synchronizing timing between video images and sound may be delayed in advance. However, whether to perform only the conventional decoding and whether to perform the band extension as well as the conventional decoding depend on the reproducing apparatus to be used. Therefore, it is difficult to constantly designate the optimum synchronizing timing.

The decoding apparatus 30 needs to additionally include the band extending unit 34 for the band extension, resulting in more resources than in a decoding apparatus that does not perform the band extension.

In view of the above, decoding apparatuses that perform the band extension are expected to shorten the delay time caused by the band extension and restrain increases in resources.

The present invention has been made in view of the above circumstances, and the object thereof is to shorten the delay time caused by the band extension at the time of decoding, and restrain increases in resources on the decoding side.

Solutions to Problems

A decoding apparatus according to a first aspect of the present invention includes: an obtaining unit configured to obtain, as encoding results, a lower frequency envelope of an audio signal, a lower frequency spectrum normalized by using the lower frequency envelope, a higher frequency envelope of the audio signal, and a degree of concentration of a higher frequency spectrum of the audio signal; a generating unit configured to generate a spectrum by using the normalized lower frequency spectrum and the higher frequency envelope in the encoding results obtained by the obtaining unit; a randomizing unit configured to randomize a phase of the spectrum, based on the degree of concentration, the spectrum being generated by the generating unit; and a combining unit configured to denormalize the lower frequency spectrum by using the lower frequency envelope in the encoding results obtained by the obtaining unit, and combine the spectrum randomized by the randomizing unit or the spectrum generated by the generating unit with the denormalized lower frequency spectrum, a result of the combination being used as a spectrum of an entire band.

A decoding method and a program of the first aspect of the present invention correspond to the decoding apparatus of the first aspect of the present invention.

In the first aspect of the present invention, the lower frequency envelope of an audio signal, the lower frequency spectrum normalized by using the lower frequency envelope, the higher frequency envelope of the audio signal, and the degree of concentration of the higher frequency spectrum of the audio signal are obtained as encoding results. A spectrum is generated by using the lower frequency spectrum and the higher frequency envelope in the obtained encoding results. Based on the degree of concentration, the phase of the spectrum is randomized. The lower frequency spectrum is denormalized by using the lower frequency envelope in the obtained encoding results. The randomized spectrum or the generated spectrum is combined with the denormalized lower frequency spectrum, and the combination result is used as the spectrum of the entire band.

A decoding apparatus according to a second aspect of the present invention includes: an obtaining unit configured to obtain, as encoding results, a lower frequency envelope of an audio signal, a lower frequency spectrum normalized by using the lower frequency envelope, and a higher frequency envelope of the audio signal; a generating unit configured to generate a spectrum by using the normalized lower frequency spectrum and the higher frequency envelope in the encoding results obtained by the obtaining unit; a determining unit configured to determine a degree of concentration of the lower frequency spectrum, based on the normalized lower frequency spectrum in the encoding results obtained by the obtaining unit; a randomizing unit configured to randomize a phase of the spectrum, based on the degree of concentration determined by the determining unit, the spectrum being generated by the generating unit; and a combining unit configured to denormalize the lower frequency spectrum by using the lower frequency envelope in the encoding results obtained by the obtaining unit, and combine the spectrum randomized by the randomizing unit or the spectrum generated by the generating unit with the denormalized lower frequency spectrum, a result of the combination being used as a spectrum of an entire band.

A decoding method and a program of the second aspect of the present invention correspond to the decoding apparatus of the second aspect of the present invention.

In the second aspect of the present invention, the lower frequency envelope of an audio signal, the lower frequency spectrum normalized by using the lower frequency envelope, and the higher frequency envelope of the audio signal are obtained as encoding results. A spectrum is generated by using the normalized lower frequency spectrum and the higher frequency envelope in the obtained encoding results. Based on the normalized lower frequency spectrum in the obtained encoding results, the degree of concentration of the lower frequency spectrum is determined. Based on the determined degree of concentration, the phase of the generated spectrum is randomized. The lower frequency spectrum is denormalized by using the lower frequency envelope in the obtained encoding results. The randomized spectrum or the generated spectrum is combined with the denormalized lower frequency spectrum, and the combination result is used as the spectrum of the entire band.

An encoding apparatus according to a third aspect of the present invention includes: a determining unit configured to determine a degree of concentration of a higher frequency spectrum of an audio signal, based on the higher frequency spectrum; an extracting unit configured to extract an envelope of a lower frequency spectrum and an envelope of the higher frequency spectrum from a spectrum of the audio signal; a normalizing unit configured to normalize the lower frequency spectrum by using the envelope of the lower frequency spectrum; and a multiplexing unit configured to obtain encoding results by multiplexing the degree of concentration determined by the determining unit, the envelope of the lower frequency spectrum and the envelope of the higher frequency spectrum extracted by the extracting unit, and the lower frequency spectrum normalized by the normalizing unit.

An encoding method and a program of the third aspect of the present invention correspond to the encoding apparatus of the third aspect of the present invention.

In the third aspect of the present invention, the degree of concentration of the higher frequency spectrum of an audio signal is determined, based on the higher frequency spectrum. The envelope of the lower frequency spectrum and the envelope of the higher frequency spectrum are extracted from the spectrum of the audio signal. The lower frequency spectrum is normalized by using the envelope of the lower frequency spectrum. The determined degree of concentration, the extracted envelope of the lower frequency spectrum, the extracted envelope of the higher frequency spectrum, and the normalized lower frequency spectrum are multiplexed, to obtain encoding results.

The decoding apparatus of the first or second aspect and the encoding apparatus of the third aspect may be independent of each other, or may be internal blocks constituting an apparatus.

Effects of the Invention

According to the first and second aspects of the present invention, the delay time caused by the band extension at the time of decoding can be shortened, and increases in resources can be restrained.

According to the third aspect of the present invention, encoding can be performed so that the delay time caused by the band extension at the time of decoding can be shortened, and increases in resources on the decoding side can be restrained.

MODE FOR CARRYING OUT THE INVENTION

First Embodiment

Example Structure of First Embodiment of Encoding Apparatus

Figure 6:
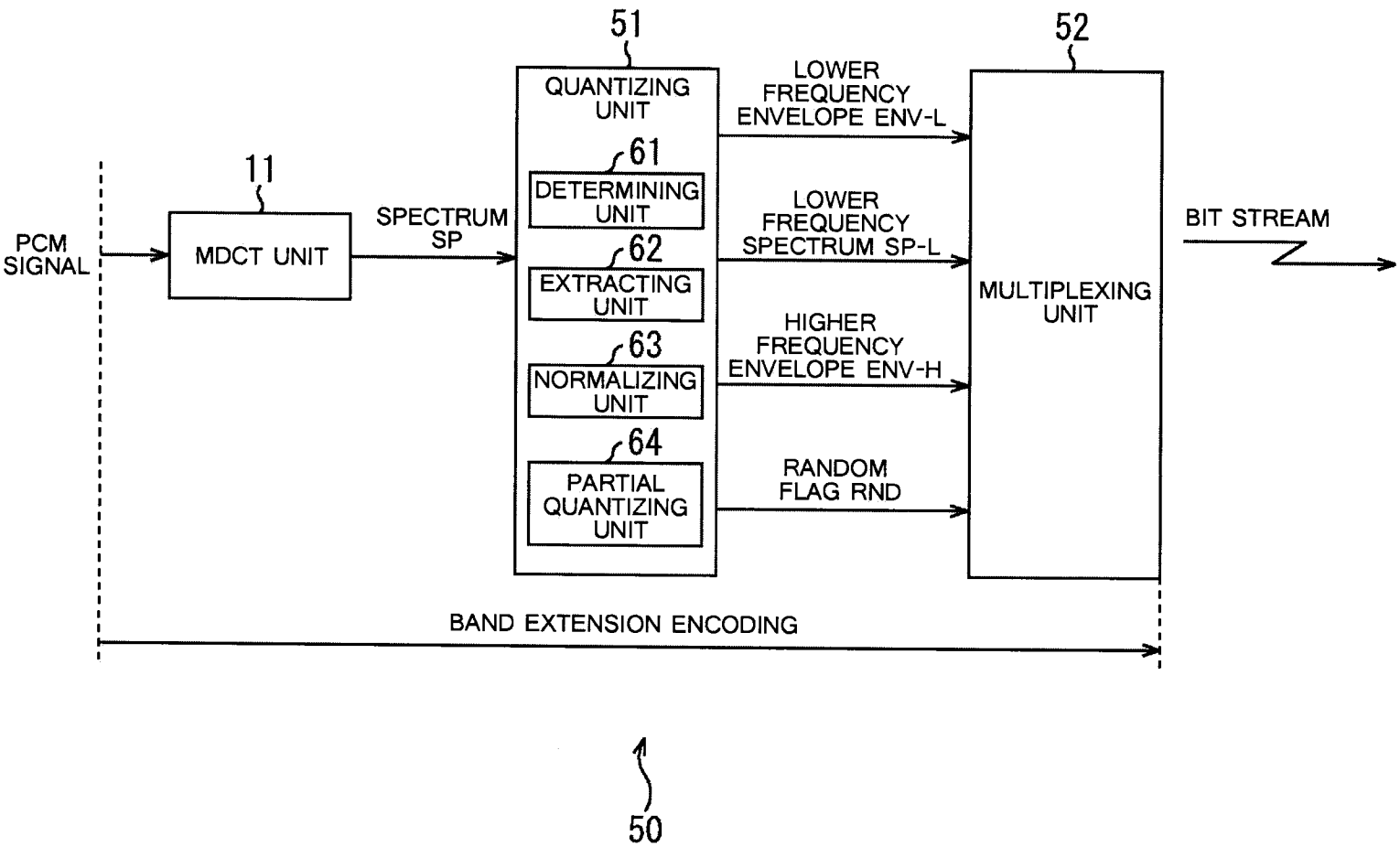
FIG. 6 is a block diagram showing an example structure of a first embodiment of an encoding apparatus to which the present invention is applied.

FIG. 6 is a block diagram showing an example structure of a first embodiment of an encoding apparatus to which the present invention is applied.

Figure 1:
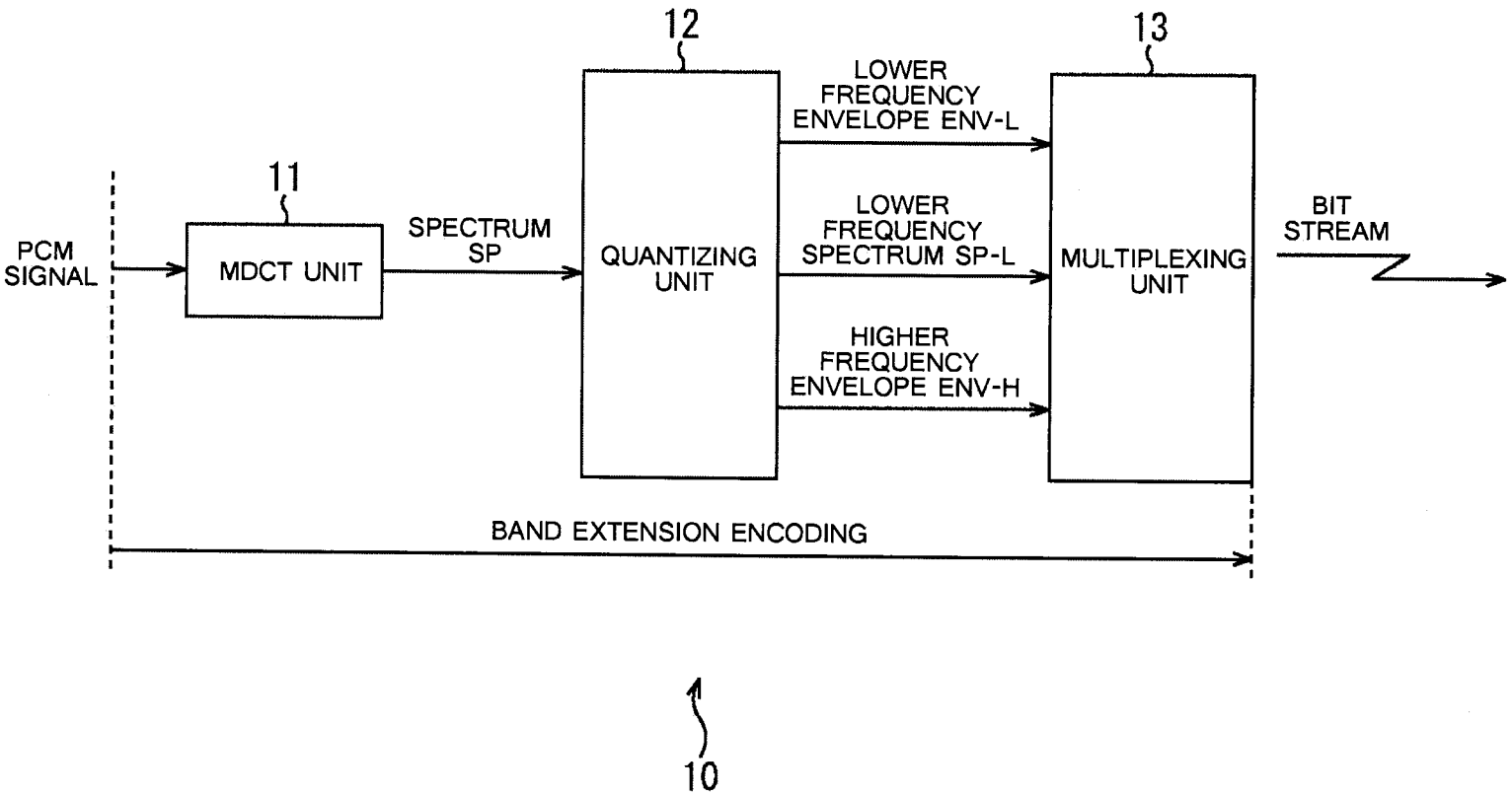
FIG. 1 is a block diagram showing an example structure of an encoding apparatus.

In the structure shown in FIG. 6, the same components as those shown in FIG. 1 are denoted by the same reference numerals as those shown in FIG. 1, and the same explanation will not be repeated.

The structure of the encoding apparatus 50 of FIG. 6 differs from the structure of FIG. 1 in that the quantizing unit 12 and the multiplexing unit 13 are replaced with a quantizing unit 51 and a multiplexing unit 52. The encoding apparatus 10 generates a bit stream by multiplexing a random flag RND (described later in detail) as well as a lower frequency envelope ENV-L, a lower frequency spectrum SP-L, and a higher frequency envelope ENV-H.

Specifically, the quantizing unit 51 of the encoding apparatus 50 includes a determining unit 61, an extracting unit 62, a normalizing unit 63, and a partial quantizing unit 64.

Based on the higher frequency spectrum SP-H of a spectrum SP supplied from a MDCT unit 11, the determining unit 61 determines the degree of concentration D of the higher frequency spectrum SP-H according to the following equation (1):

$$D=\max(SP\text{-}H)/\mathrm{ave}(SP\text{-}H) \quad (1)$$

In the equation (1), max(SP-H) represents the maximum value of the higher frequency spectrum SP-H, and ave(SP-H) represents the average value of the higher frequency spectrum SP-H.

According to the equation (1), in a case where the tone characteristics of the higher frequency components of the sound to be encoded are prominent and the distribution of the higher frequency spectrum SP-H has a high degree of bias, the degree of concentration D is high. In a case where the noise characteristics of the higher frequency components of the sound to be encoded are prominent and the distribution of the higher frequency spectrum SP-H is uniform, the degree of concentration D is low.

The determining unit 61 determines the random flag RND, based on the degree of concentration D. The random flag RND is a flag that indicates whether to randomize the phase of the spectrum to approximate the higher frequency spectrum SP-H generated from the lower frequency spectrum SP-L and the higher frequency envelope ENV-H in a band extending operation in a later described decoding apparatus.

In a case where the degree of concentration D is higher than a threshold value that is set in the encoding apparatus 50 in advance, or where the tone characteristics of the higher frequency spectrum SP-H are prominent, for example, the random flag RND is set to 0, which indicates that randomization is not to be performed. In a case where the degree of concentration D is equal to or lower than the predetermined threshold value, or where the noise characteristics of the higher frequency spectrum SP-H are prominent, the random flag RND is set to 1, which indicates randomization is to be performed. The determining unit 61 supplies the determined random flag RND to the multiplexing unit 52.

Like the quantizing unit 12 of FIG. 1, the extracting unit 62 extracts envelopes from the higher frequency spectrum SP-H and the lower frequency spectrum SP-L of the spectrum SP supplied from the MDCT unit 11.

Like the quantizing unit 12, the normalizing unit 63 normalizes the lower frequency spectrum SP-L, using the lower frequency envelope ENV-L.

The partial quantizing unit 64 performs quantization on the normalized lower frequency spectrum SP-L, and supplies the resultant lower frequency spectrum SP-L to the multiplexing unit 52. Like the quantizing unit 12, the partial quantizing unit 64 also quantizes the extracted higher frequency envelope ENV-H and lower frequency envelope ENV-L. Like the quantizing unit 12, the partial quantizing unit 64 supplies the quantized higher frequency envelope ENV-H and lower frequency envelope ENV-L to the multiplexing unit 52.

The multiplexing unit 52 multiplexes the random flag RND supplied from the determining unit 61 of the quantizing unit 51, as well as the lower frequency envelope ENV-L, the lower frequency spectrum SP-L, and the higher frequency envelope ENV-H, which are supplied from the partial quantizing unit 64. The multiplexing unit 52 outputs the resultant bit stream. This bit stream is recorded on a recording medium (not shown), or is transferred to a decoding apparatus.

[Description of Signals in the Encoding Apparatus]

Figure 7:
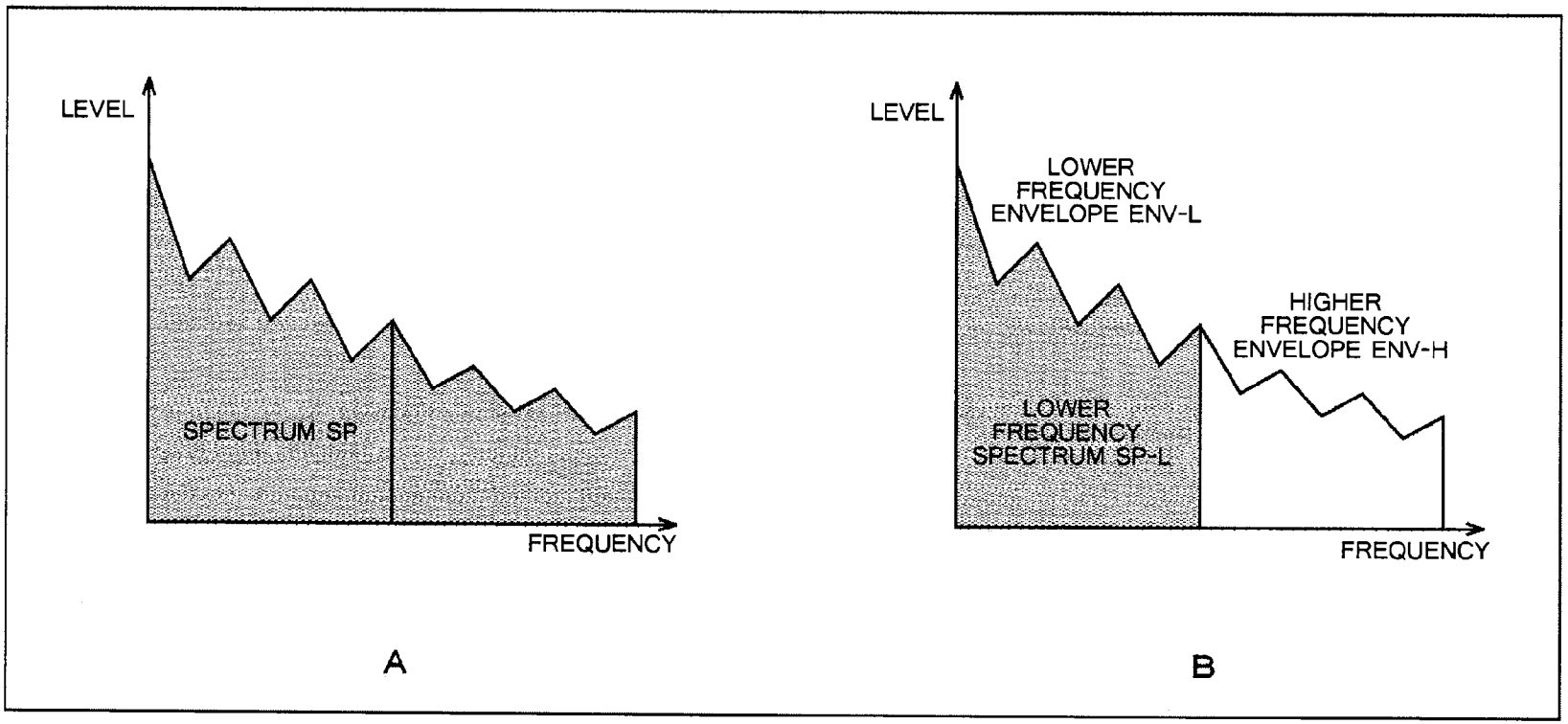
FIG. 7 is a diagram for explaining the signals that are output from the MDCT unit and the quantizing unit of FIG. 6.

FIG. 7 is a diagram for explaining the signals that are output from the MDCT unit 11 and the quantizing unit 51 of the encoding apparatus 50 of FIG. 6.

As shown in A in FIG. 7, the spectrum SP that is output from the MDCT unit 11 is a spectrum of the entire band. On the other hand, the signal that is output from the quantizing unit 51 and excludes the random flag RND includes the lower frequency spectrum SP-L, the lower frequency envelope ENV-L, and the higher frequency envelope ENV-H, as shown in B in FIG. 7.

[Description of Operation of the Encoding Apparatus]

Figure 8:
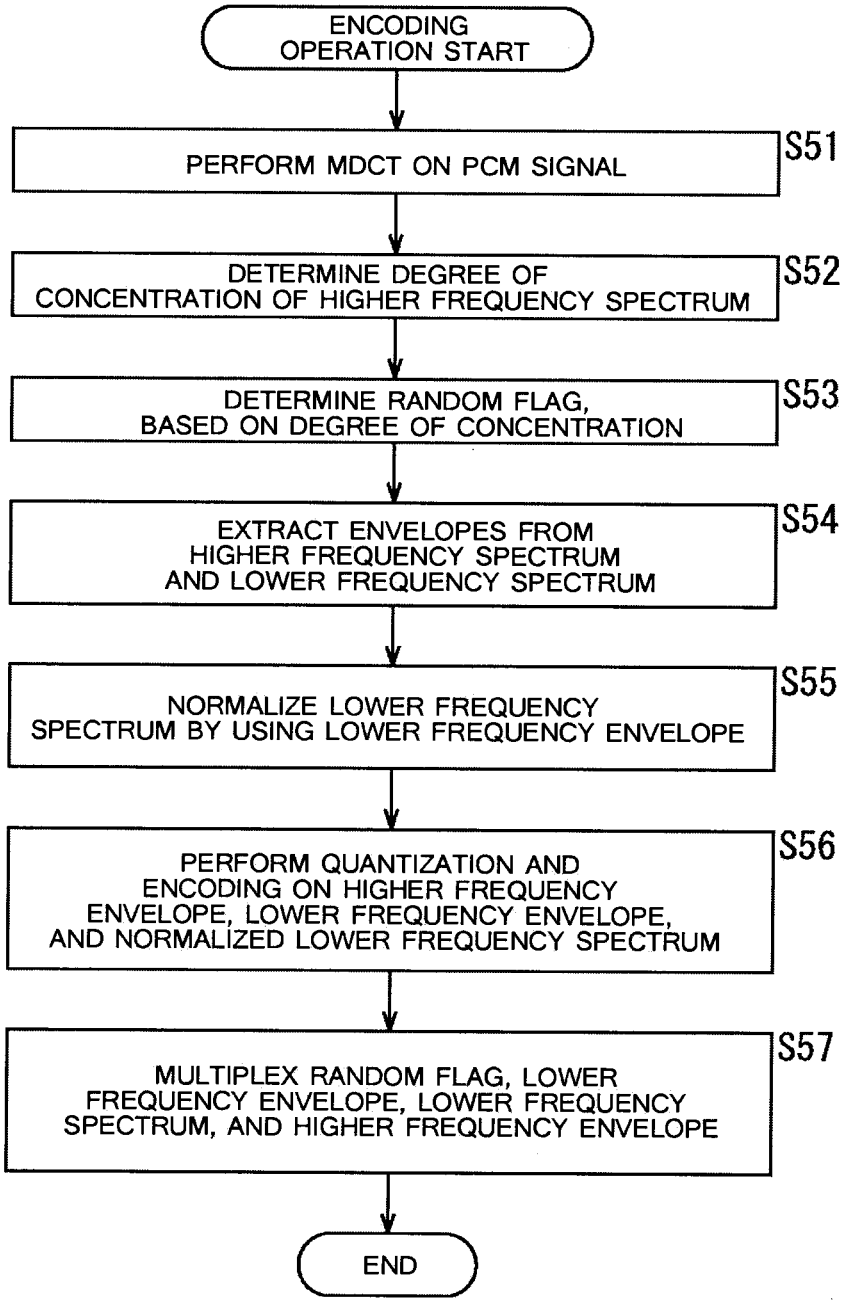
FIG. 8 is a flowchart for explaining an encoding operation to be performed by the encoding apparatus of FIG. 6.

FIG. 8 is a flowchart for explaining an encoding operation to be performed by the encoding apparatus 50 of FIG. 6. This encoding operation is started when an audio PCM signal is input to the encoding apparatus 50, for example.

Figure 2:
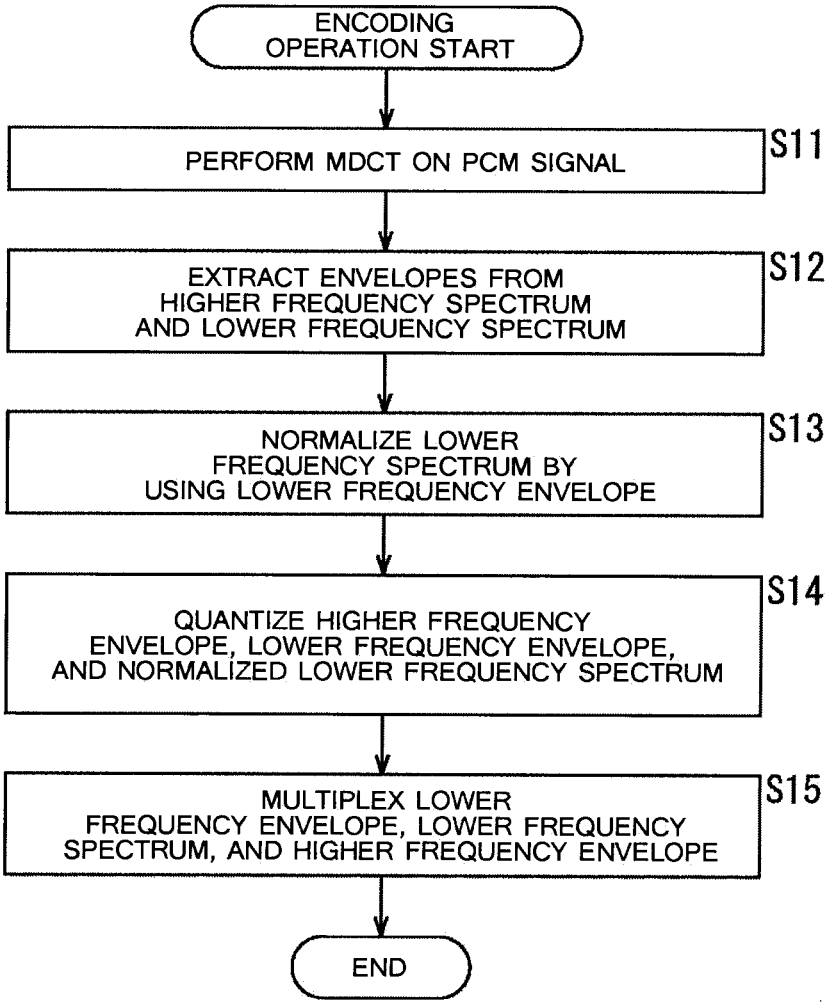
FIG. 2 is a flowchart for explaining an encoding operation to be performed by the encoding apparatus of FIG. 1.

In step S51 of FIG. 8, the MDCT unit 11 performs a MDCT on the PCM signal that is an audio time-domain signal input to the encoding apparatus 50, to generate the spectrum SP, which is a frequency domain signal, as in step S11 of FIG. 2. The MDCT unit 11 supplies the generated spectrum SP to the quantizing unit 51.

In step S52, based on the higher frequency spectrum SP-H of the spectrum SP supplied from the MDCT unit 11, the determining unit 61 of the quantizing unit 51 determines the degree of concentration D of the higher frequency spectrum SP-H according to the above described equation (1).

In step S53, the determining unit 61 determines the random flag RND, based on the degree of concentration D. The determining unit 61 supplies the determined random flag RND to the multiplexing unit 52, and the operation moves on to step S54.

The procedures of steps S54 through S56 are the same as the procedures of steps S12 through S14 of FIG. 2, and therefore, explanation of them is not repeated herein.

After the procedure of step S56, the multiplexing unit 52, in step S57, multiplexes the random flag RND, the lower frequency envelope ENV-L, the lower frequency spectrum SP-L, and the higher frequency envelope ENV-H, which are supplied from the quantizing unit 51. The multiplexing unit 52 outputs the resultant bit stream. The operation then comes to an end.

[Example Structure of the Decoding Apparatus]

Figure 9:
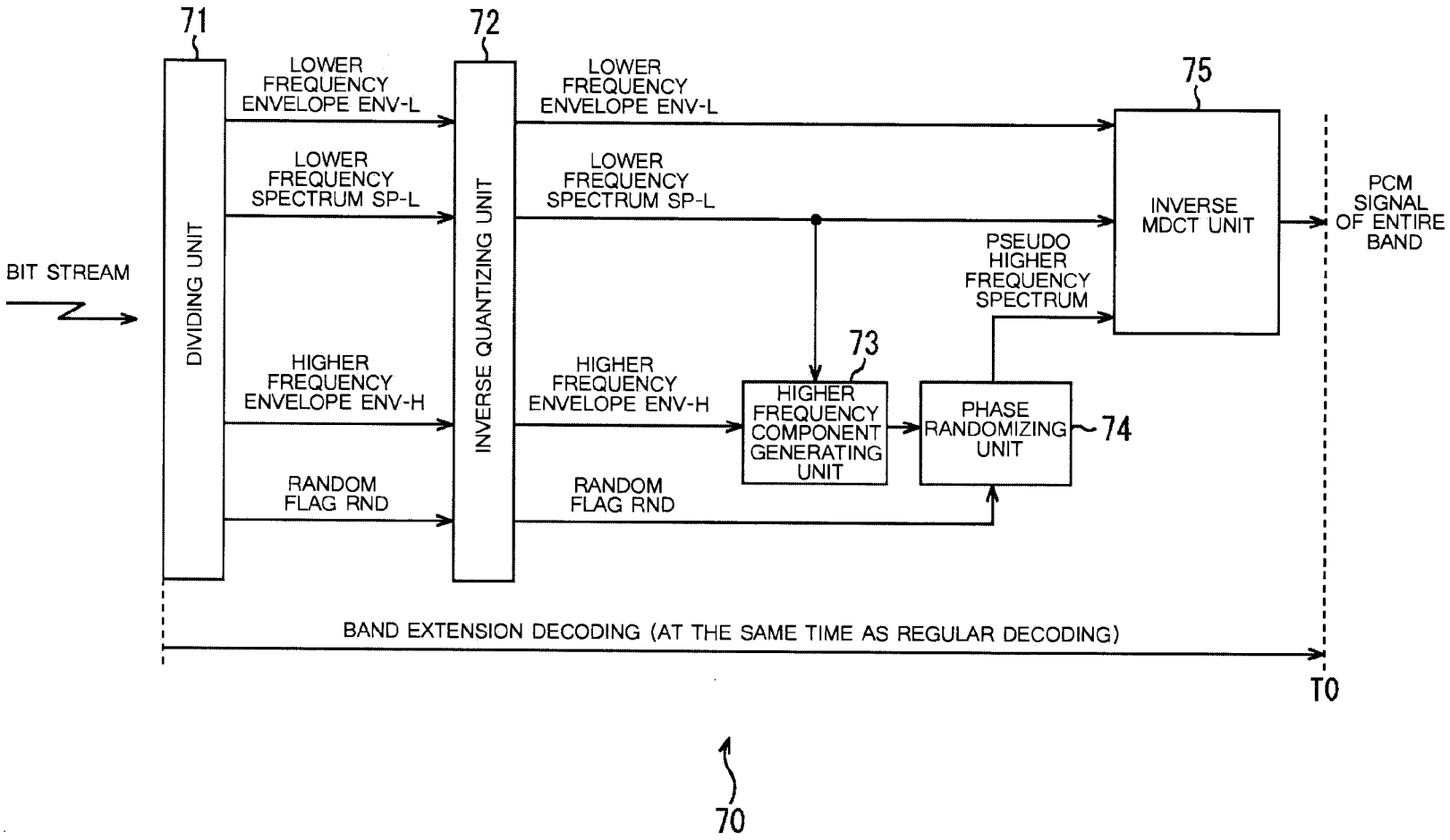
FIG. 9 is a block diagram showing an example structure of a decoding apparatus that decodes bit streams encoded by the encoding apparatus of FIG. 6.

FIG. 9 is a block diagram showing an example structure of the decoding apparatus that decodes bit streams encoded by the encoding apparatus 50 of FIG. 6.

The decoding apparatus 70 of FIG. 9 includes a dividing unit 71, an inverse quantizing unit 72, a higher frequency component generating unit 73, a phase randomizing unit 74, and an inverse MDCT unit 75. The decoding apparatus 70 performs a band extending operation at the same time as decoding of the lower frequency spectrum SPL.

Specifically, the dividing unit 71 (an obtaining unit) obtains a bit stream encoded by the encoding apparatus 50 of FIG. 6. The dividing unit 71 divides the bit stream into the random flag RND, the lower frequency envelope ENV-L, the lower frequency spectrum SP-L, and the higher frequency envelope ENV-H, which are then supplied to the inverse quantizing unit 72.

Figure 3:
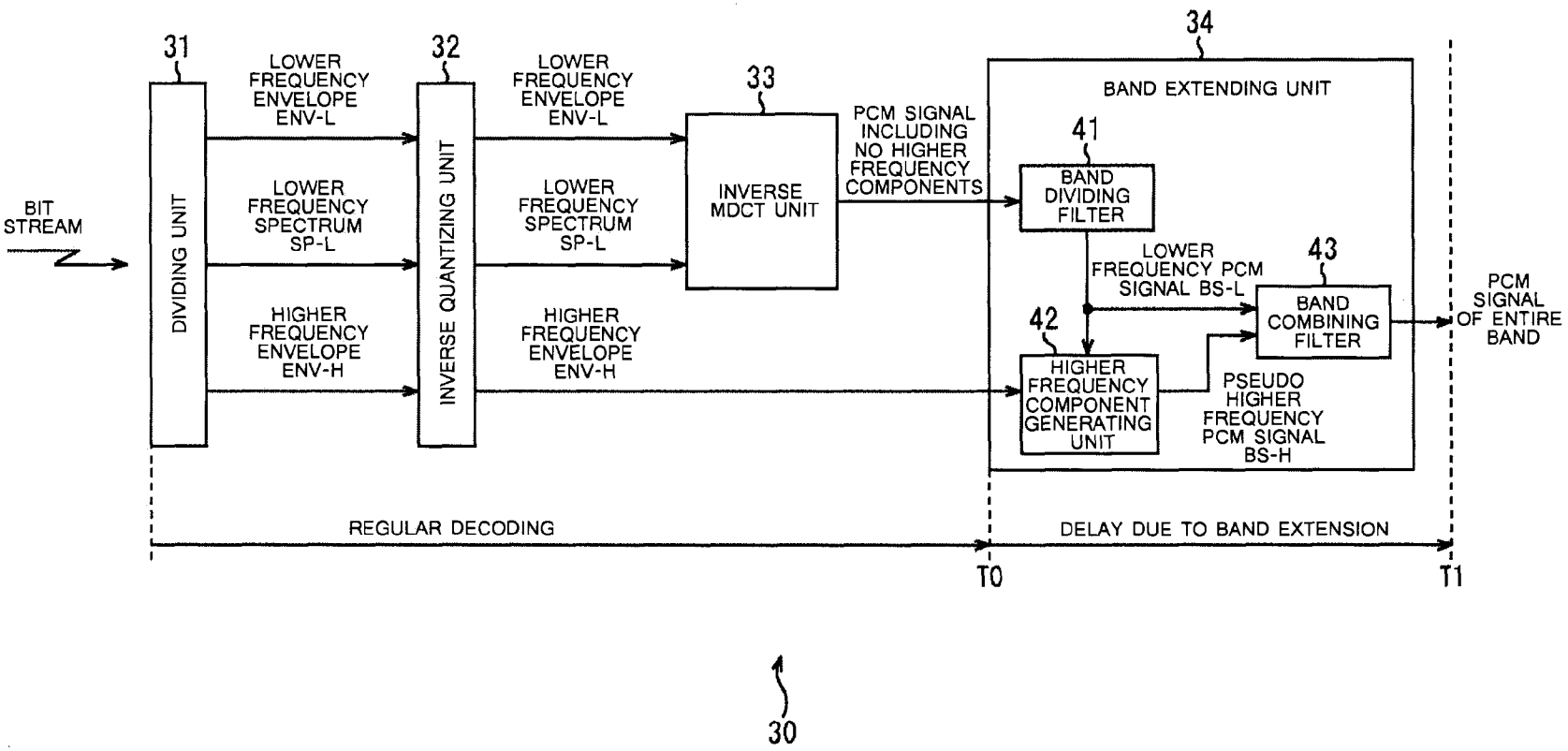
FIG. 3 is a block diagram showing an example structure of a decoding apparatus.
Figure 4:
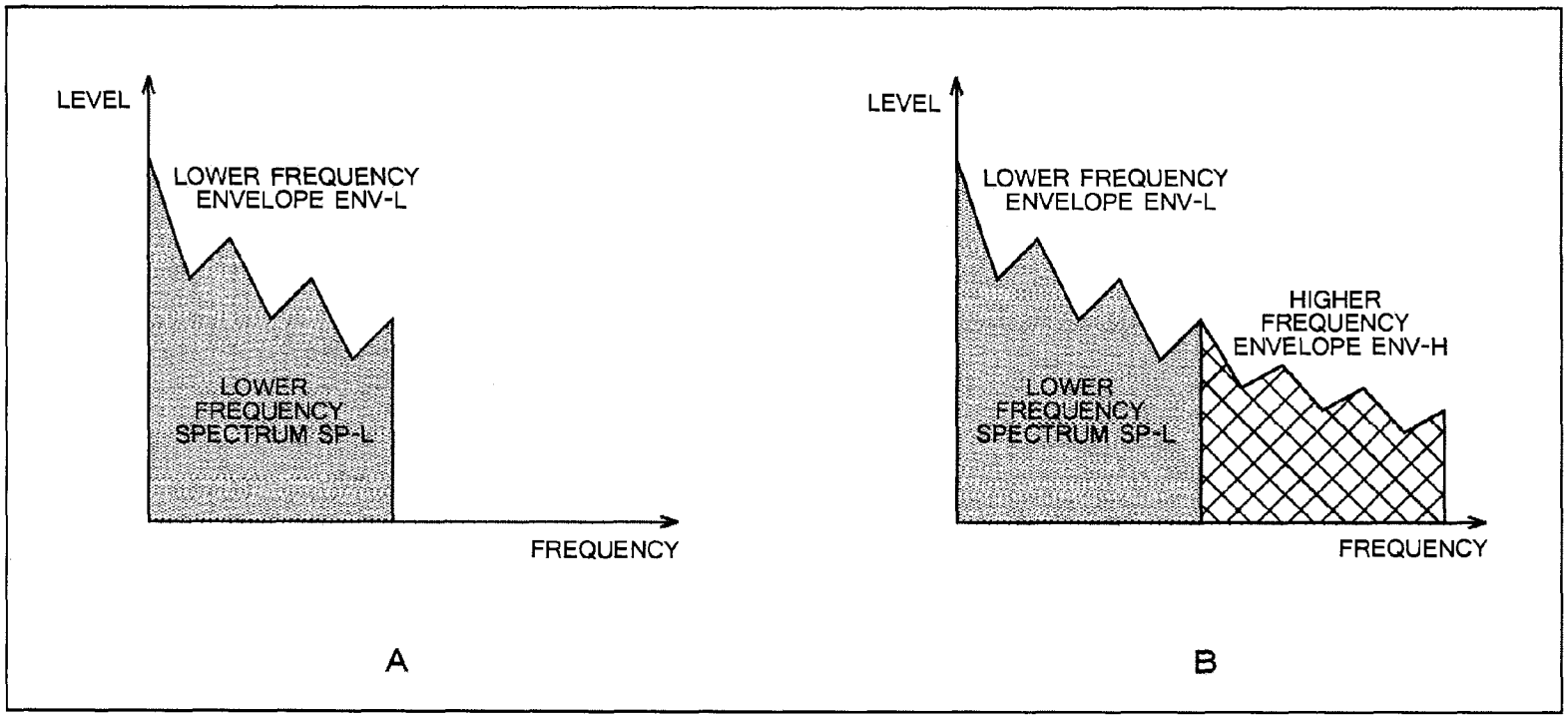
FIG. 4 is a diagram for explaining the signals that are output from the inverse MDCT unit and the band combining filter.
Figure 5:
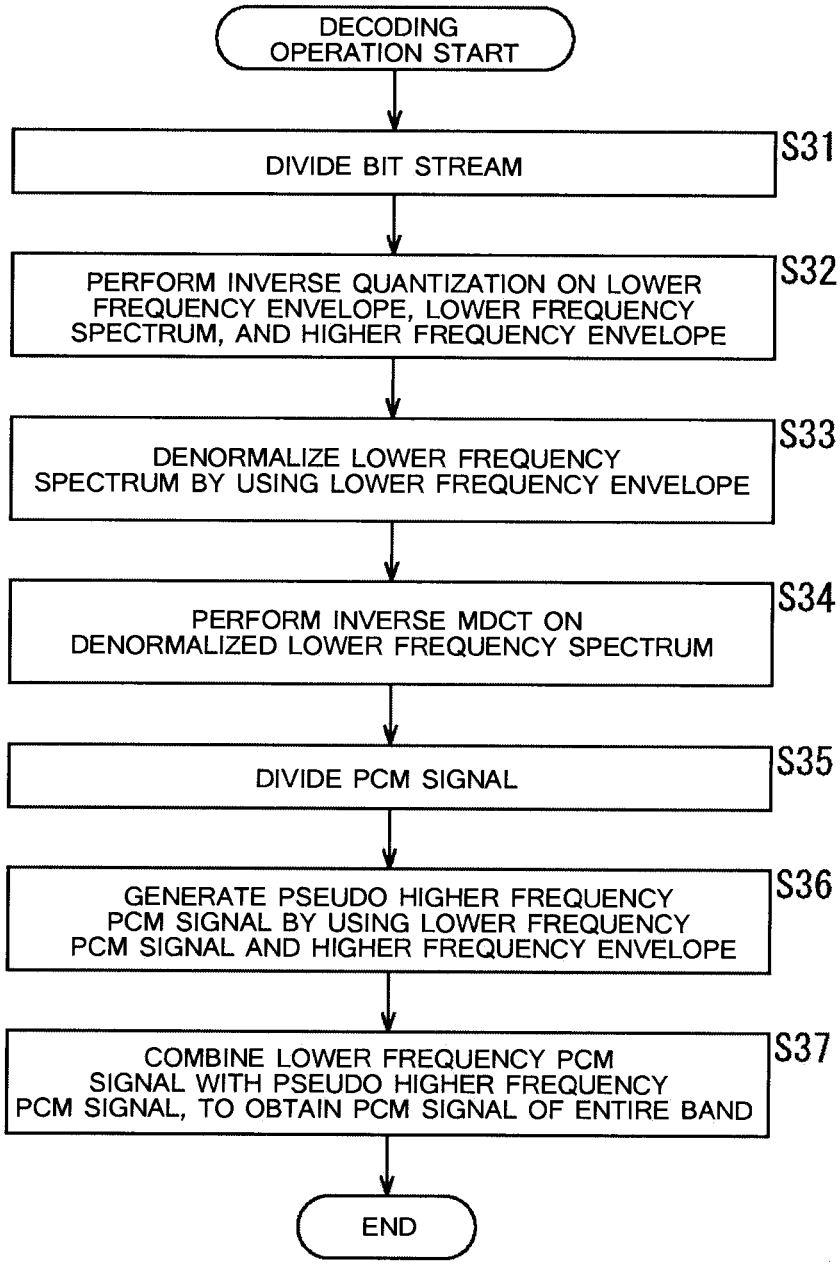
FIG. 5 is a flowchart for explaining a decoding operation to be performed by the decoding apparatus of FIG. 3.

Like the inverse quantizing unit 32 of FIG. 3, the inverse quantizing unit 72 performs inverse quantization on the lower frequency envelope ENV-L, the lower frequency spectrum SP-L, and the higher frequency envelope ENV-H, which are supplied from the dividing unit 71.

The inverse quantizing unit 72 supplies the inversely-quantized lower frequency envelope ENV-L to the inverse MDCT unit 75, and supplies the lower frequency spectrum SP-L to the inverse MDCT unit 75 and the higher frequency component generating unit 73. The inverse quantizing unit 72 also supplies the higher frequency envelope ENV-H to the higher frequency component generating unit 73, and supplies the random flag RND to the phase randomizing unit 74.

Using the lower frequency spectrum SP-L and the higher frequency envelope ENV-H, which are supplied from the inverse quantizing unit 72, the higher frequency component generating unit 73 generates a higher frequency spectrum to be a pseudo higher frequency spectrum. Specifically, the higher frequency component generating unit 73 duplicates the lower frequency spectrum SP-L, and deforms the duplicated spectrum by using the higher frequency envelope ENV-H, to form the pseudo higher frequency spectrum.

To generate this pseudo higher frequency spectrum, the technique disclosed in Patent Document 1, which was filed by the applicant, may be used, or some other technique may also be used. The higher frequency component generating unit 73 supplies the generated pseudo higher frequency spectrum to the phase randomizing unit 74.

Based on the random flag RND supplied from the inverse quantizing unit 72, the phase randomizing unit 74 randomizes the phase of the pseudo higher frequency spectrum supplied from the higher frequency component generating unit 73.

Specifically, in a case where the random flag RND is 1, which indicates that randomization is to be performed, the phase randomizing unit 74 randomizes the sign (+ or −) of the pseudo higher frequency spectrum, according to the following equation (2):

$$SP\text{-}H(i)=-1\hat{}(\text{rand}(\ )\ \&\ 0\times1)\times SP\text{-}H(i) \tag{2}$$

In the equation (2), SP-H represents the higher frequency spectrum, and i represents the spectrum number.

According to the equation (2), the higher frequency spectrum SP-H is multiplied by "−1" the number of times indicated by the lowest 1 bit of the return value of the random function rand( ), so that −1 or 1 is randomly assigned to the sign of the higher frequency spectrum SP-H.

In a case where the random flag RND is 0, which indicates that randomization is not to be performed, the phase randomizing unit 74 does not randomize the phase of the pseudo higher frequency spectrum.

The phase randomizing unit 74 supplies the pseudo higher frequency spectrum having its phase randomized or the pseudo higher frequency spectrum not having its phase randomized to the inverse MDCT unit 75.

The inverse MDCT unit 75 (a combining unit) denormalizes the lower frequency spectrum SP-L, using the lower frequency envelope ENV-L supplied from the inverse quantizing unit 72. The inverse MDCT unit 75 combines the denormalized lower frequency spectrum SP-L with the pseudo higher frequency spectrum supplied from the phase randomizing unit 74. The inverse MDCT unit 75 performs an inverse MDCT on the entire-band spectrum that is a frequency domain signal obtained as a result of the combination. By doing so, the inverse MDCT unit 75 obtains an entire-band PCM signal that is a time domain signal. The inverse MDCT unit 75 outputs the entire-band PCM signal as the results of the decoding.

As described above, the decoding apparatus 70 generates the pseudo higher frequency spectrum at the same time as decoding of the lower frequency spectrum SP-L. Accordingly, the time required for decoding in the decoding apparatus 70 is substantially the same as the time required for decoding in a conventional decoding apparatus that performs only decoding. That is, the decoding apparatus 70 of FIG. 9 can output results of decoding after time TO has passed from the time of the bit stream input. In other words, any delay is not caused by a band extension in the decoding apparatus 70.

[Description of Signals in the Decoding Apparatus]

Figure 10:
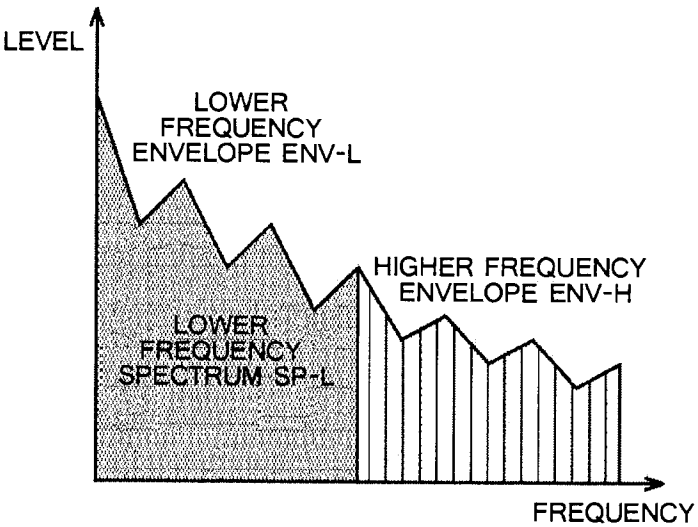
FIG. 10 is a diagram for explaining the signal that is output from the inverse MDCT unit of FIG. 9.

FIG. 10 is a diagram for explaining the signal that is output from the inverse MDCT unit 75 of the decoding apparatus 70 of FIG. 9.

The signal that is output from the inverse MDCT unit 75 is a PCM signal obtained after a frequency transform is performed on the result of the combination of the lower frequency spectrum SP-L normalized by using the lower frequency envelope ENV-L as shown in FIG. 10, and the pseudo higher frequency spectrum generated from the higher frequency envelope ENV-H and the lower frequency spectrum SP-L as shown in FIG. 10.

[Description of Effects of Phase Randomization]

FIGS. 11 through 16 are diagrams for explaining the effects of phase randomization performed by the phase randomizing unit 74 of FIG. 9.

Figure 11:
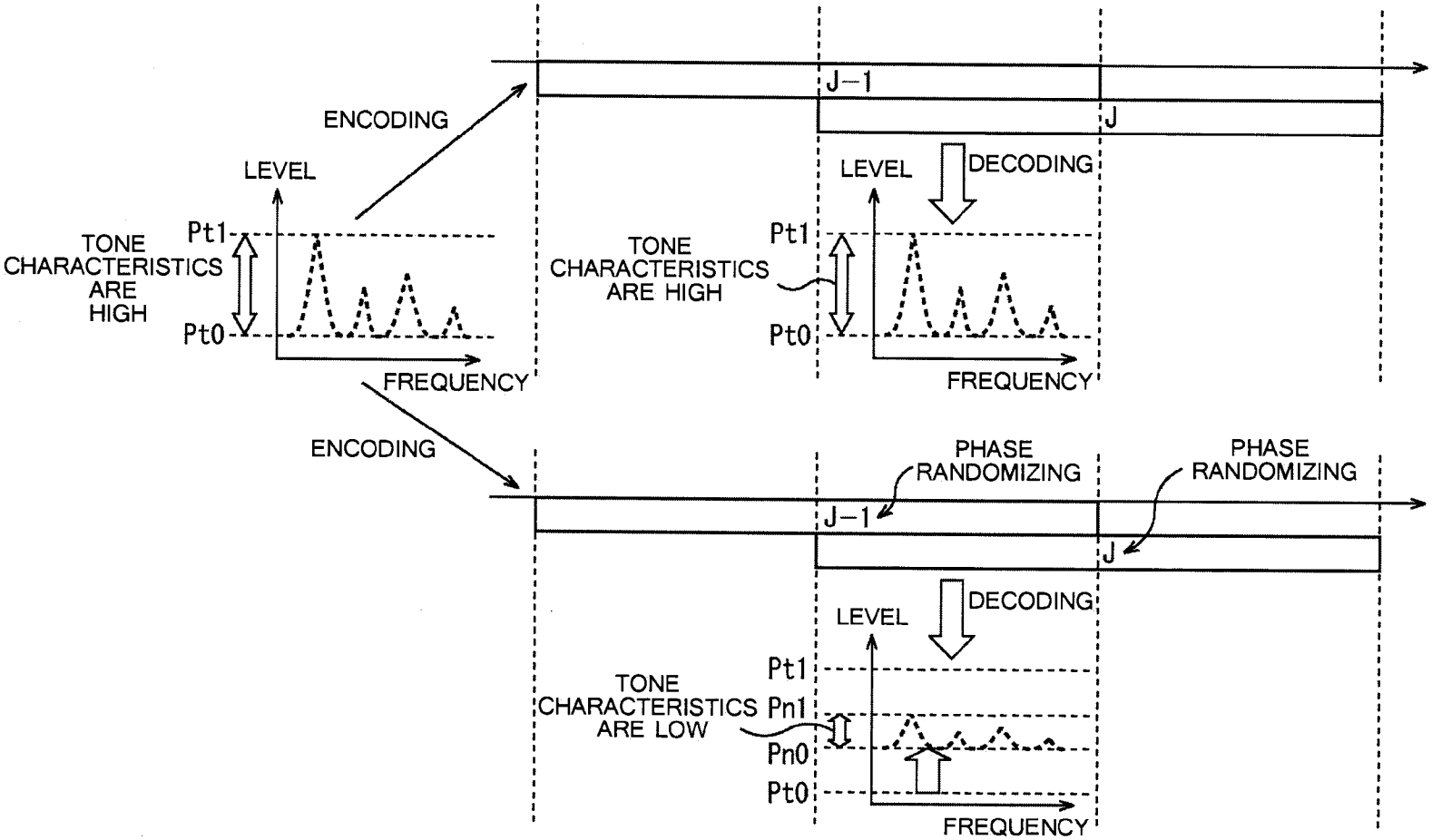
FIG. 11 is a diagram for explaining the difference in decoding results between a case where phase randomization is performed and a case where phase randomization is not performed.

FIG. 11 is a diagram for explaining the difference in decoding results between a case where phase randomization is performed and a case where phase randomization is not performed.

As shown in FIG. 11, the encoding apparatus 50 of FIG. 6 encodes a PCM signal in each section called a frame having a constant length. Those frames normally overlap one another by 50%. Specifically, the (J−1)th frame and the Jth frame overlap each other by half a frame, as shown in FIG. 11.

FIG. 11 illustrates a case where a spectrum with distinctive tone characteristics is encoded, as shown on the left side of FIG. 11.

In this case, where the phase of the spectrum is not randomized at the time of decoding of the spectrums of the (J−1)th and Jth frames as shown in the upper right portion of FIG. 11, the phase of the spectrum of the overlapping period between the (J−1)th frame and the Jth frame is accurately restored by a combination of the signs and the spectrums of the (J−1)th and Jth frames. Accordingly, the restored spectrum of the overlapping period is a spectrum with distinctive tone characteristics.

Where the phase of the spectrum is randomized at the time of decoding of the spectrums of the (J−1) th and Jth frames as shown in the lower right portion, on the other hand, the signs of the spectrums of the (J−1) th and Jth frames are not always the same. Therefore, the phase of the spectrum of the overlapping period is not accurately restored. As a result, the restored signal of the overlapping period in the decoding apparatus 70 is a spectrum having poorer tone characteristics than the tone characteristics of the spectrum prior to the encoding.

As the tone characteristics of the spectrum become poorer, the energy originally concentrating on the specific spectrum leaks into the surrounding spectrums. Therefore, the peaks (tops) of the spectrum are more restrained compared with the original spectrum, and the energy of the bottoms of the spectrum is boosted by the energy leaking into the surroundings. As a result, the spectrum acquires noise characteristics.

As described above, where phase randomization is performed at the time of decoding, the spectrum having tone characteristics prior to encoding is transformed into a spectrum having noise characteristics.

FIGS. 12 through 16 are diagrams for explaining the characteristics of the higher frequency spectrum SP-H.

Figure 12:
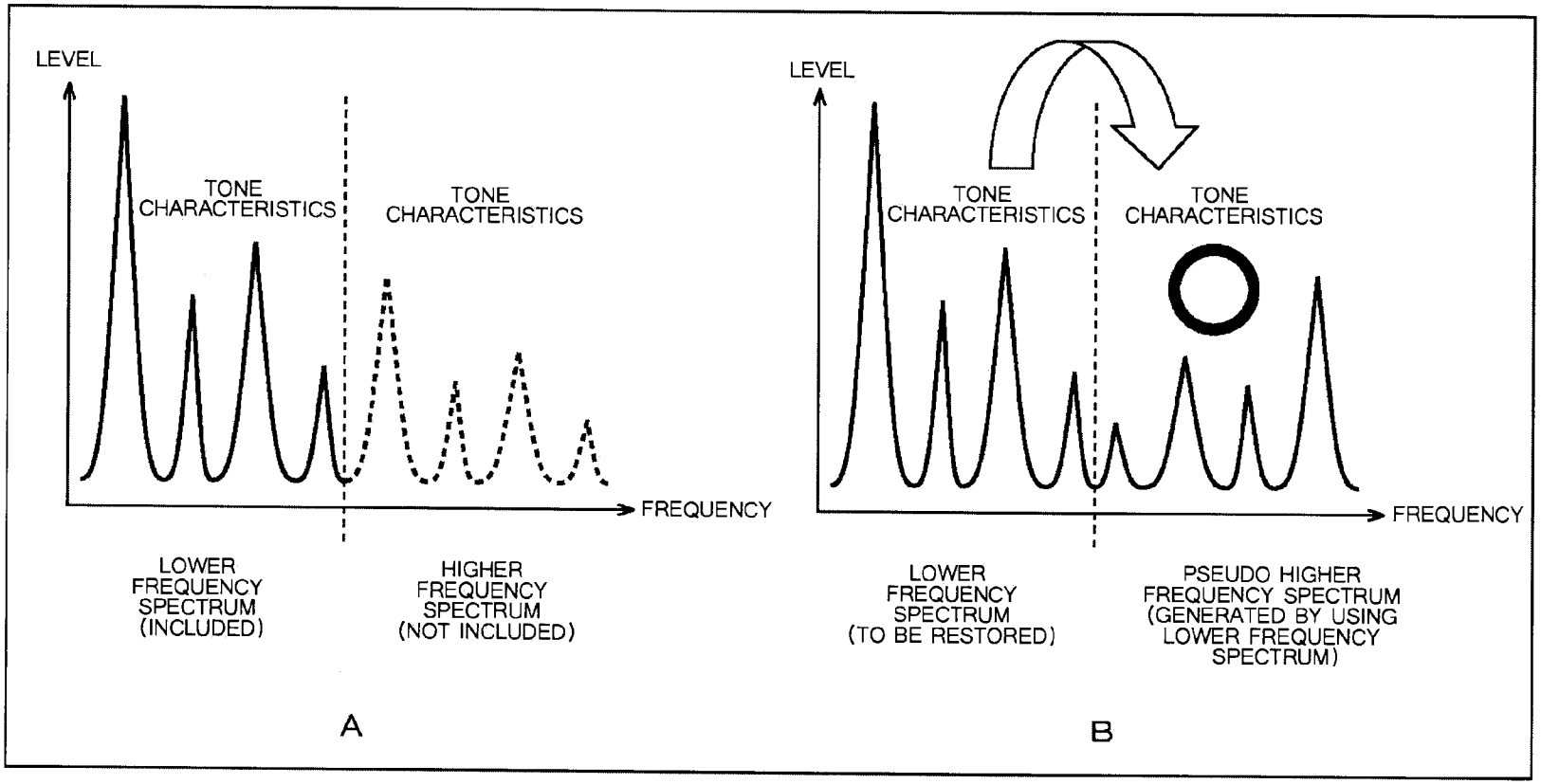
FIG. 12 is a diagram for explaining the characteristics of the higher frequency spectrum SP-H.

As shown in A in FIG. 12, where the tone characteristics of the lower frequency spectrum SP-L are distinctive, the tone characteristics of the higher frequency spectrum SP-H are often distinctive too. This can be deduced from the fact that instruments such as wind instruments and string instruments emit sound waves that are a combination of basic frequency and harmonic components that are integral multiples of the basic frequency.

In a case where band extension encoding is performed on the spectrum formed with the lower frequency spectrum SP-L and the higher frequency spectrum SP-H, which have distinctive tone characteristics, a pseudo higher frequency spectrum that is generated by simply replicating the lower frequency spectrum SP-L at the time of band extension decoding is a spectrum with distinctive tone characteristics as shown in B in FIG. 12. Accordingly, the sound corresponding to the results of decoding is hardly disagreeable to the ear.

Therefore, in a case where the degree of concentration D is higher than the predetermined threshold value, or where the higher frequency components of the sound to be encoded have tone characteristics, the encoding apparatus 50 of FIG. 6 sets the random flag RND to 0. Therefore, the phase of the pseudo higher frequency spectrum is not randomized in the decoding apparatus 70. Accordingly, the sound corresponding to the results of decoding is hardly disagreeable to the ear.

Figure 13:
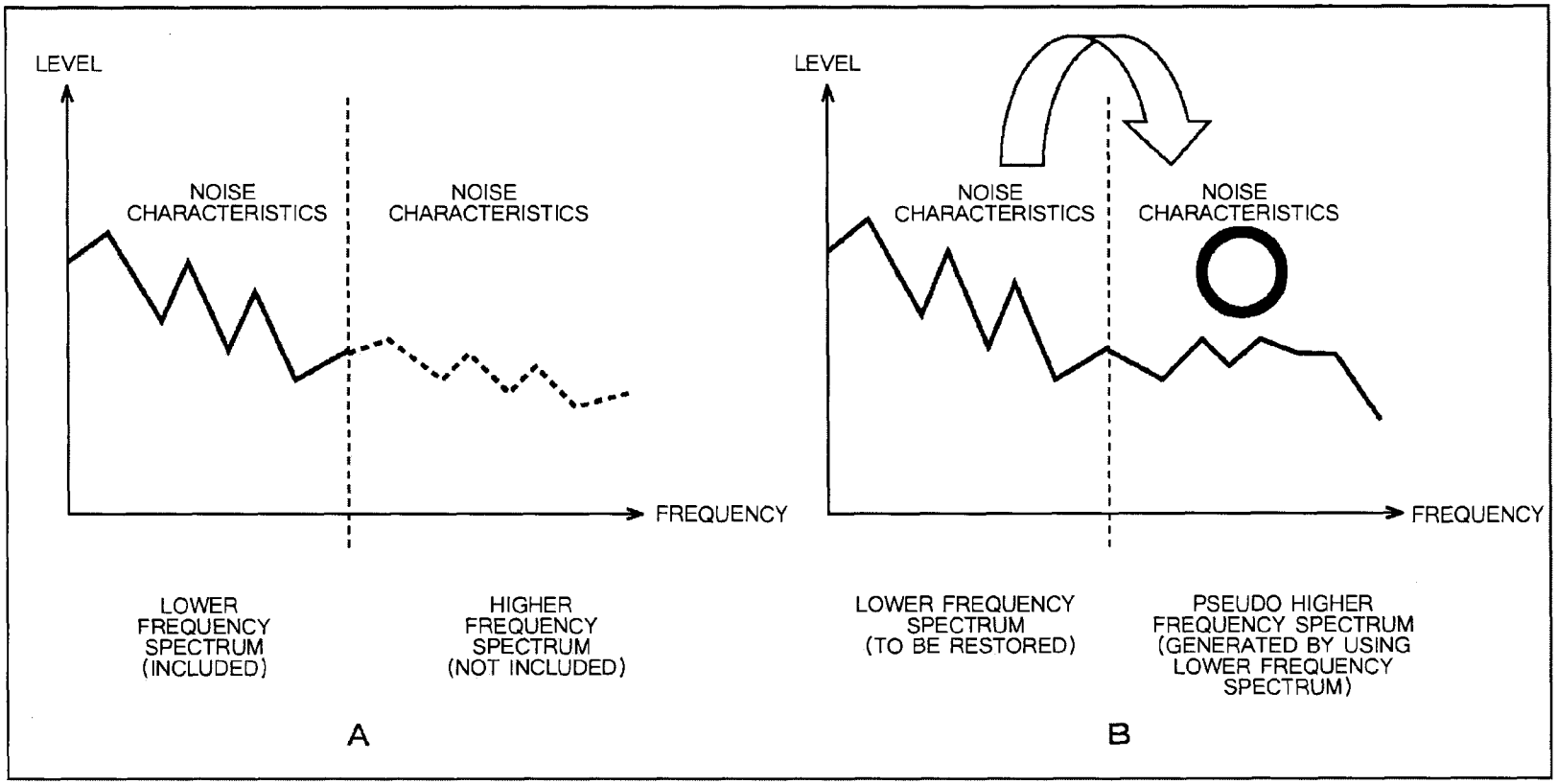
FIG. 13 is a diagram for explaining the characteristics of the higher frequency spectrum SP-H.
Figure 14:
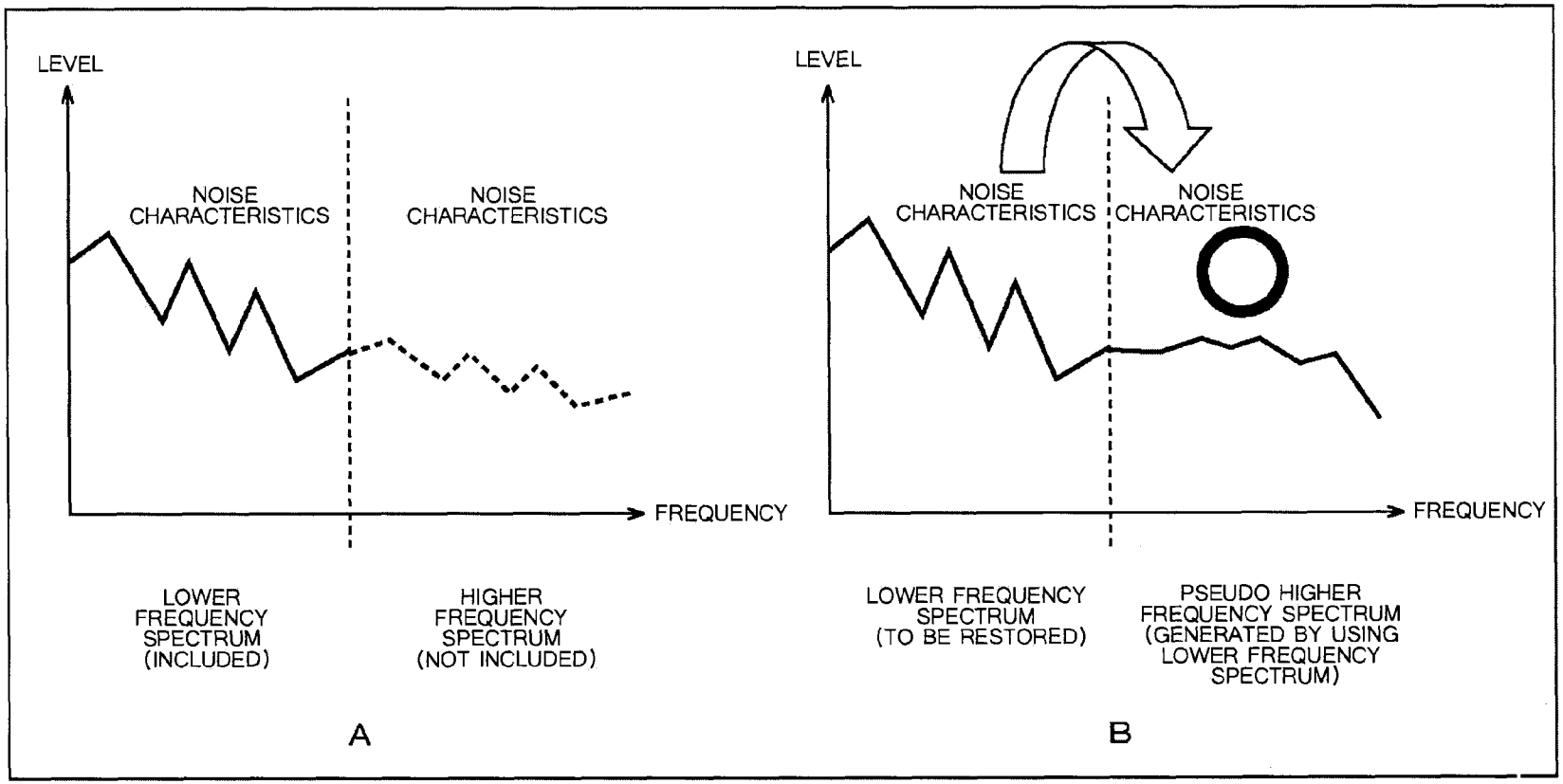
FIG. 14 is a diagram for explaining the characteristics of the higher frequency spectrum SP-H.

In a case where the lower frequency spectrum SP-L has distinctive noise characteristics, the noise characteristics become more distinctive at higher frequencies, as shown in A in FIG. 13 and A in FIG. 14. This can be deduced from the fact that vibrations of higher frequencies propagate in instruments such as cymbals and maracas that emits hit sound and impact sound with distinctive noise characteristic or without tone characteristics, and higher frequency sound has more distinctive noise characteristics, with the amplitudes and phases of the respective vibration factors being intricately intertwined.

In a case where band extension encoding is performed on a spectrum formed with the lower frequency spectrum SP-L and the higher frequency spectrum SP-H having distinctive noise characteristics as described above, a pseudo higher frequency spectrum generated by using the lower frequency spectrum SP-L at the time of band extension decoding is a spectrum with distinctive noise characteristics as shown in B in FIG. 13. Therefore, where phase randomization is not performed on the pseudo higher frequency spectrum as shown in B in FIG. 13 or where phase randomization is performed as shown in B in FIG. 14, the noise characteristics of the pseudo higher frequency spectrum are distinctive, and the sound corresponding to the results of decoding is hardly disagreeable to the ear.

However, the lower frequency components of sound of instruments with distinctive noise characteristics such as cymbals or maracas might contain tonic vibrational components. Also, the frequencies of sound of instruments such as cymbals and maracas are mainly high frequencies, and there is a possibility that the lower frequency components also contain sound with distinctive tone characteristics. Therefore, even in a case where the noise characteristics of the higher frequency spectrum SP-H are distinctive, the tone characteristics of the lower frequency spectrum SP-L might be distinctive as shown in A in FIG. 15 and A in FIG. 16.

Figure 15:
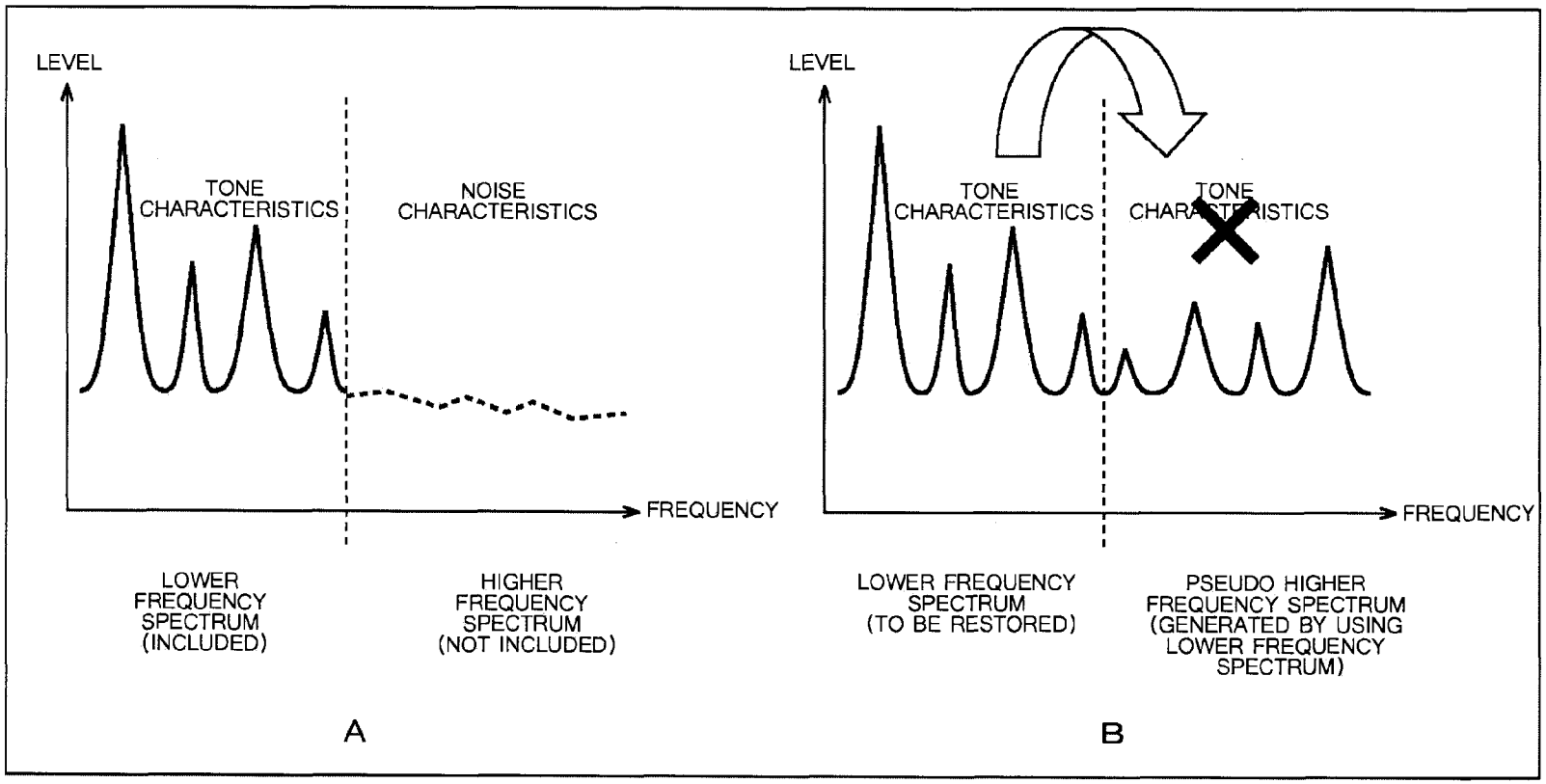
FIG. 15 is a diagram for explaining the characteristics of the higher frequency spectrum SP-H.

In a case where band extension encoding is performed on a spectrum formed with the lower frequency spectrum SP-L with distinctive tone characteristics and the higher frequency spectrum SP-H with distinctive noise characteristics as described above, a pseudo higher frequency spectrum generated by using the lower frequency spectrum SP-L at the time of band extension decoding might contain tonic components, as shown in B in FIG. 15. Therefore, if the phase of the pseudo higher frequency spectrum is not randomized as shown in B of FIG. 15, the higher frequency sound corresponding to the results of decoding does not have the original noise characteristics, but have tone characteristics like the lower frequency sound, resulting in sound that is disagreeable to the ear.

Figure 16:
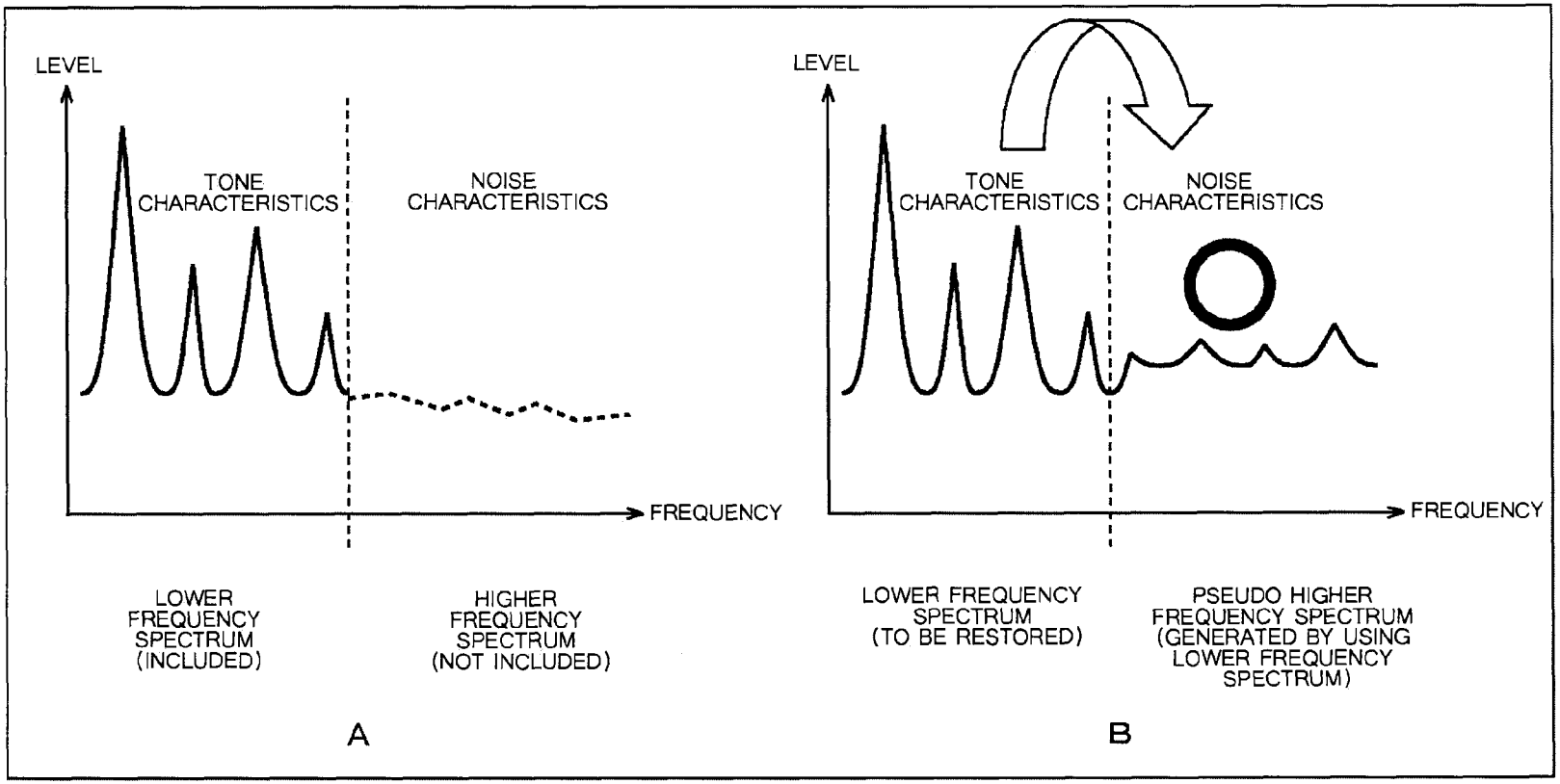
FIG. 16 is a diagram for explaining the characteristics of the higher frequency spectrum SP-H.

In a case where the phase of the pseudo higher frequency spectrum is randomized, on the other hand, the pseudo higher frequency spectrum after the randomization have noise characteristics as shown in B in FIG. 16, even if the original pseudo higher frequency spectrum contains tonic components. Accordingly, the sound corresponding to the results of decoding is hardly disagreeable to the ear.

In a case where the higher frequency spectrum SP-H has noise characteristics, randomization may be or may not be performed, if the lower frequency spectrum SP-L also has noise characteristics. In that case, however, randomization needs to be performed, if the lower frequency spectrum SP-L has tone characteristics. Therefore, in a case where the higher frequency spectrum SP-H has noise characteristics, randomization is constantly performed, so that decoding results that are hardly disagreeable to the ear can be achieved based on the degree of concentration D.

In view of this, in a case where the degree of concentration D is equal to or lower than the predetermined threshold value, or where the higher frequency components of the sound to be encoded have noise characteristics, the encoding apparatus 50 of FIG. 6 sets the random flag RND to 1. As a result, the phase of the pseudo higher frequency spectrum is randomized in the decoding apparatus 70. Accordingly, the sound corresponding to the results of decoding is hardly disagreeable to the ear.

Since there exists almost no sound that has distinctive noise characteristics at lower frequencies and distinctive tone characteristics at higher frequencies in nature, a spectrum formed with the lower frequency spectrum SP-L with distinctive noise characteristics and the higher frequency spectrum SP-H with distinctive tone characteristics is not discussed herein.

[Description of Operation of the Decoding Apparatus]

Figure 17:
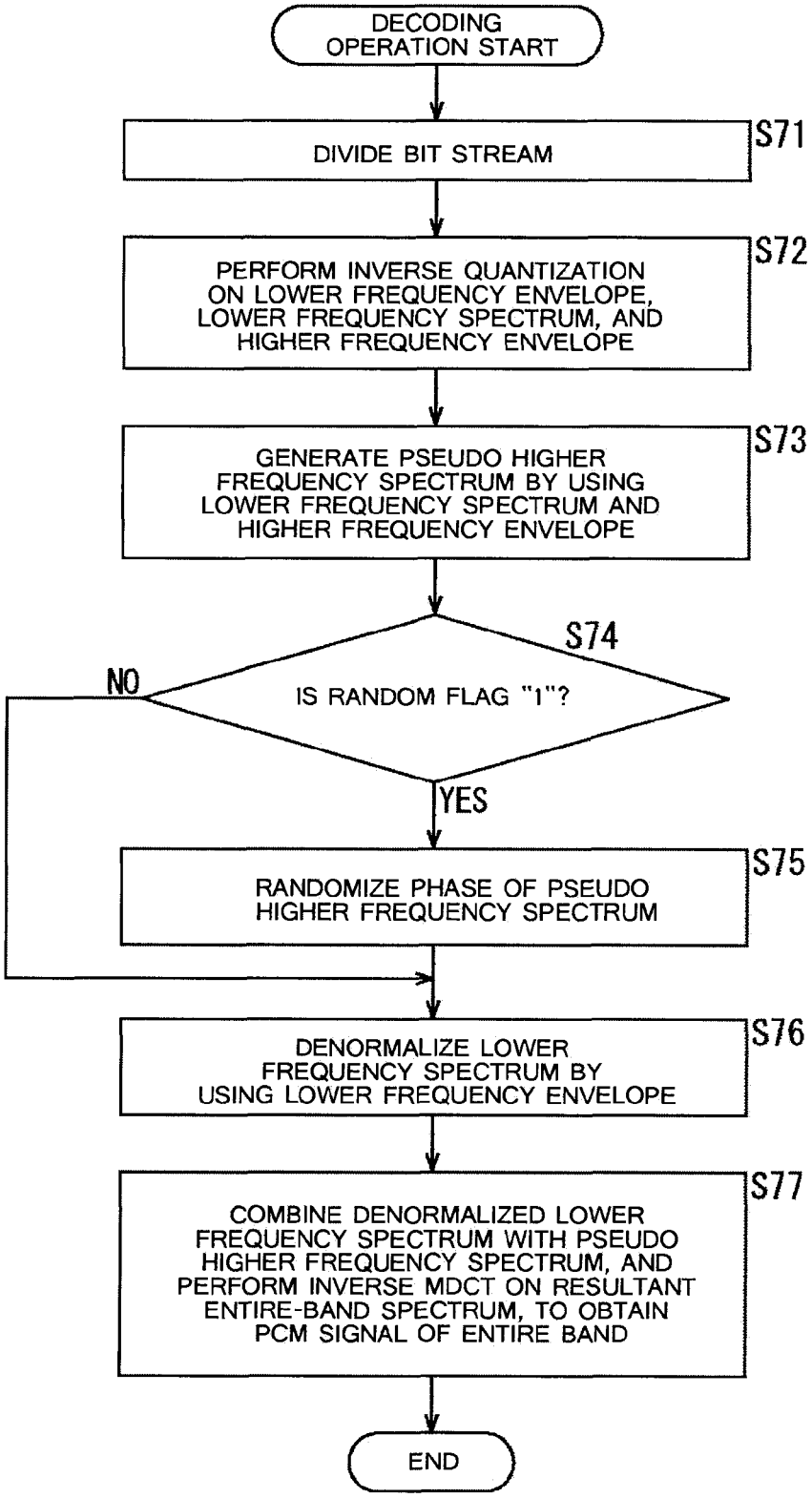
FIG. 17 is a flowchart for explaining a decoding operation to be performed by the decoding apparatus of FIG. 9.

FIG. 17 is a flowchart for explaining a decoding operation to be performed by the decoding apparatus 70 of FIG. 9. This decoding operation is started when a bit stream encoded by the encoding apparatus 50 is input to the decoding apparatus 70, for example.

In step S71 of FIG. 17, the dividing unit 71 obtains the bit stream encoded by the encoding apparatus 50, and divides the bit stream into the random flag RND, the lower frequency envelope ENV-L, the lower frequency spectrum SP-L, and the higher frequency envelope ENV-H. The dividing unit 71 supplies the random flag RND, the lower frequency envelope ENV-L, the lower frequency spectrum SP-L, and the higher frequency envelope ENV-H to the inverse quantizing unit 72.

In step S72, the inverse quantizing unit 72 performs inverse quantization on the lower frequency envelope ENV-L, the lower frequency spectrum SP-L, and the higher frequency envelope ENV-H, which are supplied from the dividing unit 71. The inverse quantizing unit 72 supplies the inversely-quantized lower frequency envelope ENV-L to the inverse MDCT unit 75, and supplies the lower frequency spectrum SP-L to the inverse MDCT unit 75 and the higher frequency component generating unit 73. Also, the inverse quantizing unit 72 supplies the higher frequency envelope ENV-H to the higher frequency component generating unit 73, and supplies the random flag RND to the phase randomizing unit 74.

In step S73, the higher frequency component generating unit 73 generates a pseudo higher frequency spectrum by using the lower frequency spectrum SP-L and the higher frequency envelope ENV-H, which are supplied from the inverse quantizing unit 72. The higher frequency component generating unit 73 supplies the generated pseudo higher frequency spectrum to the phase randomizing unit 74.

In step S74, the phase randomizing unit 74 determines whether the random flag RND supplied from the inverse quantizing unit 72 is 1. If the random flag RND is determined to be 1 in step S74, the phase randomizing unit 74, in step S75, randomizes the phase of the pseudo higher frequency spectrum supplied from the higher frequency component generating unit 73, according to the above described equation (2). The phase randomizing unit 74 then supplies the pseudo higher frequency spectrum having its phase randomized to the inverse MDCT unit 75, and the operation moves on to step S76.

If the random flag RND is determined not to be 1 or is determined to be 0 in step S74, the phase randomizing unit 74 does not randomize the phase of the pseudo higher frequency spectrum, and supplies the pseudo higher frequency spectrum as it is to the inverse MDCT unit 75. The operation then moves on to step S76.

In step S76, the inverse MDCT unit 75 denormalizes the lower frequency spectrum SP-L by using the lower frequency envelope ENV-L supplied from the inverse quantizing unit 32.

In step S77, the inverse MDCT unit 75 combines the denormalized lower frequency spectrum SP-L with the pseudo higher frequency spectrum supplied from the phase randomizing unit 74, and performs an inverse MDCT on the resultant entire-band spectrum. By doing so, the inverse MDCT unit 75 obtains an entire-band PCM signal. The inverse MDCT unit 75 outputs the entire-band PCM signal as decoding results, and the operation comes to an end.

As described above, the decoding apparatus 70 generates the pseudo higher frequency spectrum by using the lower frequency spectrum SP-L prior to the inverse MDCT, and randomizes the pseudo higher frequency spectrum in accordance with the random flag RND determined based on the degree of concentration of the higher frequency spectrum SP-H. By doing so, the decoding apparatus 70 restores the higher frequency components of the spectrum of the sound to be encoded.

By using the lower frequency spectrum SP-L in the above manner, a spectrum that is relatively similar to the higher frequency spectrum SP-H can be restored as the higher frequency components of the spectrum of sound to be encoded. Accordingly, as the higher frequency components of the spectrum of sound to be encoded are restored by using the lower frequency spectrum SP-L, a decoding operation and a band extending operation can be simultaneously performed on the lower frequency spectrum SP-L, and the delay time caused by the band extension can be shortened. As a result, the entire-band PCM signal of sound that is not muffled and is beautiful and agreeable to the ear is output as the results of decoding after substantially the same period of time has passed as in a decoding apparatus not performing the band extension operation.

Also, the decoding apparatus 70 randomizes the phase of the pseudo higher frequency spectrum generated by using the lower frequency spectrum SP-L, to generate a pseudo higher frequency spectrum with noise characteristics. Accordingly, the decoding apparatus 70 can generate a pseudo higher frequency spectrum that is more similar to the higher frequency spectrum SP-H than in a case where a random spectrum is simply generated as a pseudo higher frequency spectrum.

Further, the decoding apparatus 70 generates the lower frequency components and the higher frequency components of a spectrum prior to the inverse MDCT. Therefore, the decoding apparatus 70 does not need to include the band dividing filter 41 and the band combining filter 43 for band extending operations, like the decoding apparatus 30 of FIG. 3. Accordingly, the processing for band extending operations, and the resources such as the circuit size and the code size can be reduced, compared with those in the decoding apparatus 30 of FIG. 3.

Second Embodiment

Example Structure of Second Embodiment of Decoding Apparatus

Figure 18:
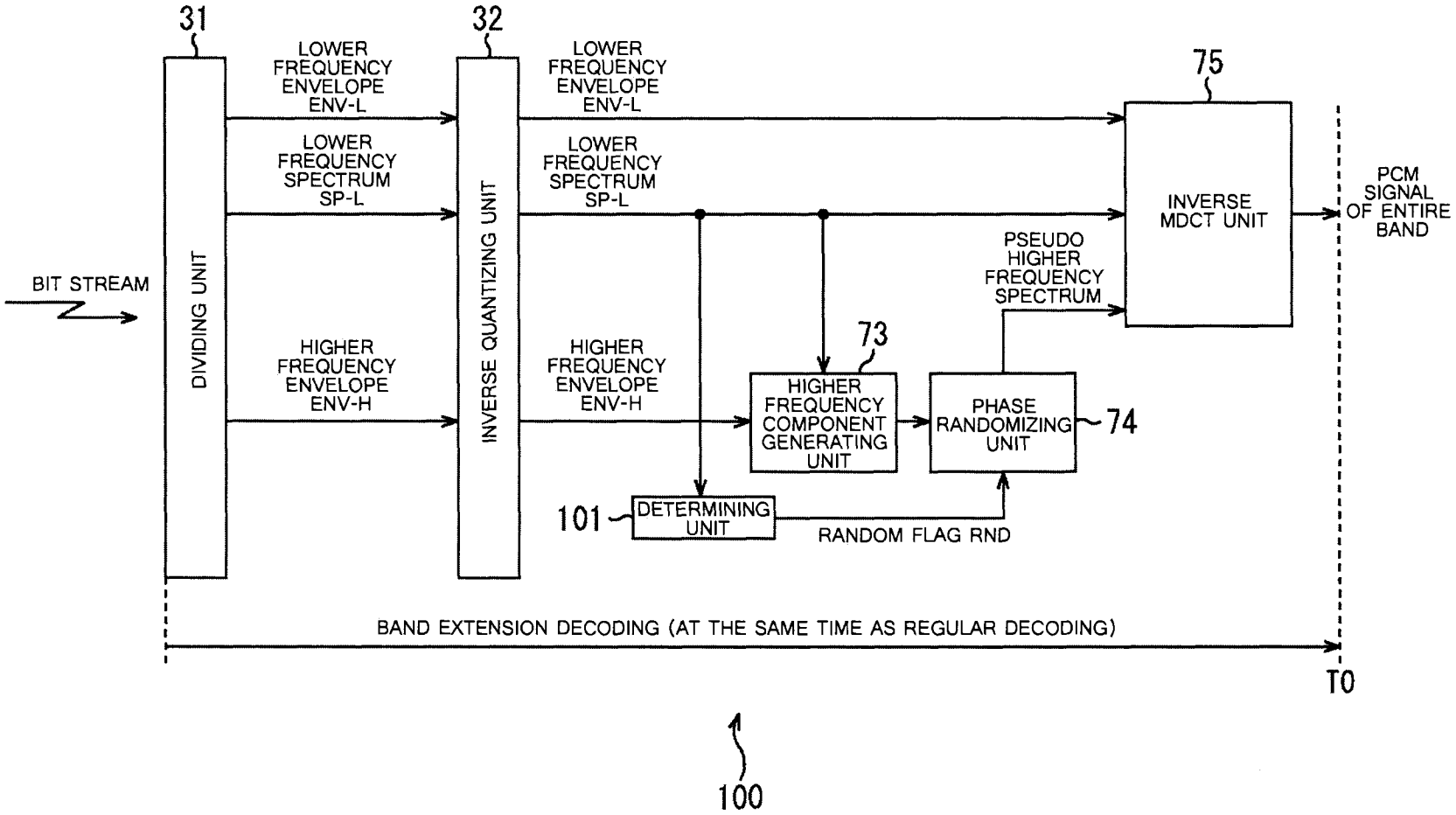
FIG. 18 is a block diagram showing an example structure of a second embodiment of a decoding apparatus to which the present invention is applied.

FIG. 18 is a block diagram showing an example structure of a second embodiment of a decoding apparatus to which the present invention is applied.

Of the components shown in FIG. 18, the same components as those shown in FIGS. 3 and 9 are denoted by the same reference numerals used in FIGS. 3 and 9, and the same explanation will not be repeated.

The structure of the decoding apparatus 100 of FIG. 18 differs from the structure of the decoding apparatus 70 of FIG. 9 in that the dividing unit 71 and the inverse quantizing unit 72 are replaced with a dividing unit 31 and an inverse quantizing unit 32, and a determining unit 101 is added. The decoding apparatus 100 determines a random flag RND, based on a lower frequency spectrum SP-L included in a bit stream encoded by the encoding apparatus 10 of FIG. 1.

Specifically, based on the lower frequency spectrum SP-L inversely-quantized by the inverse quantizing unit 32, the determining unit 101 determines the degree of concentration D' of the lower frequency spectrum SP-L according to the following equation (3), for example:

$$D' = \max(SP\text{-}L)/\mathrm{ave}(SP\text{-}L) \tag{3}$$

In the equation (3), max(SP-L) represents the maximum value of the lower frequency spectrum SP-L, and ave(SP-L) represents the average value of the lower frequency spectrum SP-L.

According to the equation (3), in a case where the tone characteristics of the lower frequency components of the sound to be encoded are distinctive and the distribution of the lower frequency spectrum SP-L has a high degree of bias, the degree of concentration D' is high. In a case where the noise characteristics of the lower frequency components of the sound to be encoded are distinctive and the distribution of the lower frequency spectrum SP-L is uniform, the degree of concentration D' is low.

The determining unit 101 determines the random flag RND, based on the degree of concentration D'. Specifically, in a case where the degree of concentration D is higher than a threshold value that is set in the decoding apparatus 100 in advance, or where the tone characteristics of the lower frequency spectrum SP-L are distinctive, the determining unit 101 determines the random flag RND to be 0. In a case where the degree of concentration D' is equal to or lower than the predetermined threshold value, or where the noise characteristics of the lower frequency spectrum SP-L are distinctive, on the other hand, the determining unit 101 determines the random flag RND to be 1. The determining unit 101 supplies the determined random flag RND to the phase randomizing unit 74. Accordingly, where the tone characteristics of the lower frequency spectrum SP-L are distinctive, the phase of a pseudo higher frequency spectrum is not randomized. Where the noise characteristics of the lower frequency spectrum SP-L are distinctive, the phase of the pseudo higher frequency spectrum is randomized. As a result, the sound corresponding to the results of decoding has a sufficiently high auditory quality.

[Description of Operation of the Decoding Apparatus]

Figure 19:
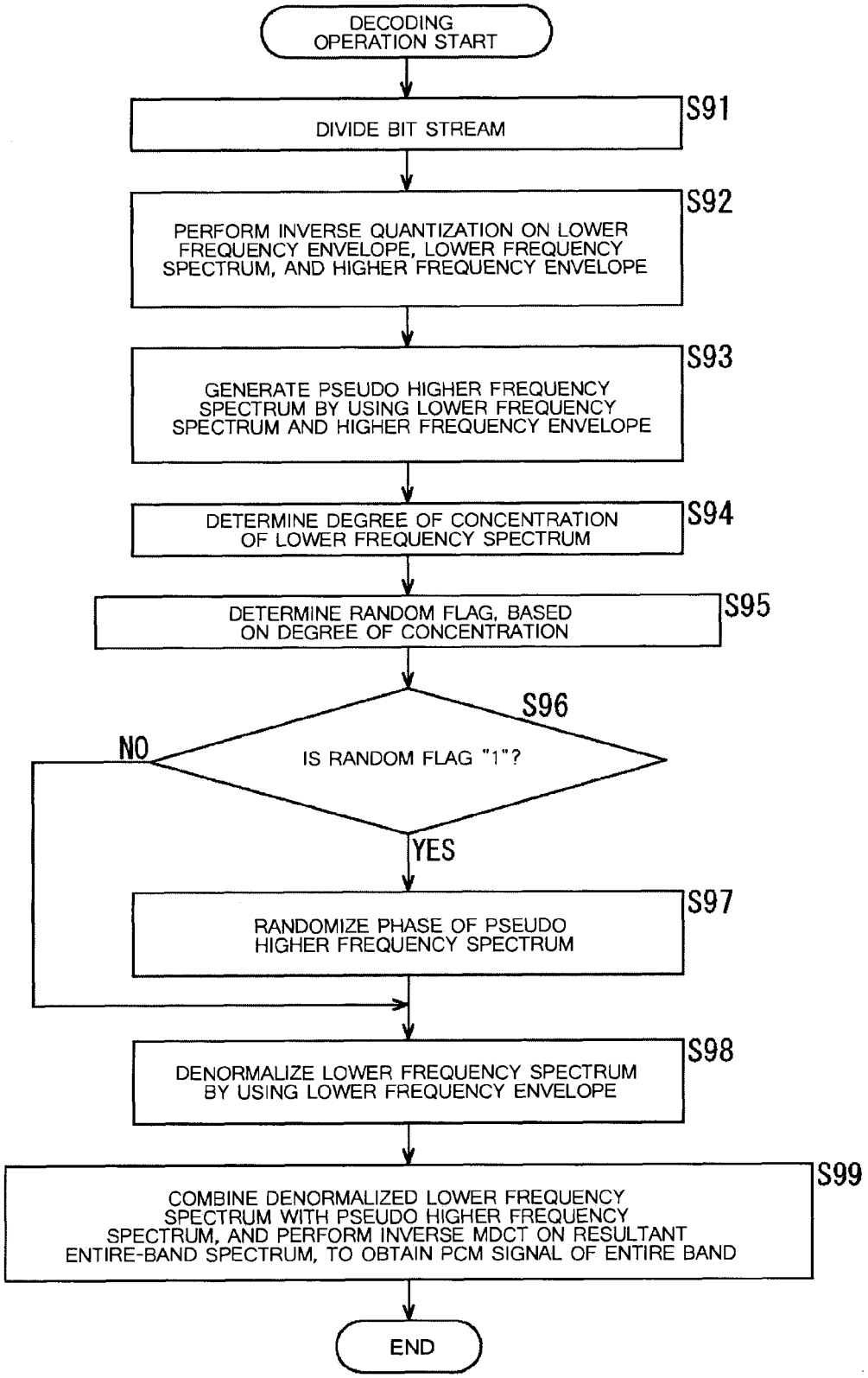
FIG. 19 is a flowchart for explaining a decoding operation to be performed by the decoding apparatus of FIG. 18.

FIG. 19 is a flowchart for explaining a decoding operation to be performed by the decoding apparatus 100 of FIG. 18. This decoding operation is started when a bit stream encoded by the encoding apparatus 10 of FIG. 1 is input to the decoding apparatus 100, for example.

In step S91 of FIG. 19, the dividing unit 31 divides the bit stream encoded by the encoding apparatus 10 into a lower frequency envelope ENV-L, the lower frequency spectrum SP-L, and a higher frequency envelope ENV-H, which are then supplied to the inverse quantizing unit 32.

The procedures of steps S92 and S93 are the same as the procedures of steps S72 and S73 of FIG. 17, and therefore, explanation of them is not repeated herein.

After the procedure of step S93, the determining unit 101, in step S94, determines the degree of concentration D' of the lower frequency spectrum SP-L according to the above described equation (3), based on the lower frequency spectrum SP-L inversely-quantized by the inverse quantizing unit 32.

In step S95, the determining unit 101 determines the random flag RND, based on the degree of concentration D'. The determining unit 101 supplies the random flag RND to the phase randomizing unit 74, and the operation moves on to step S96.

The procedures of steps S96 through S99 are the same as the procedures of steps S74 through S77 of FIG. 17, and therefore, explanation of them is not repeated herein.

Third Embodiment

Description of Computer to which the Present Invention is Applied

The above described series of encoding procedures and decoding procedures can be carried out by hardware or software. In a case where the series of encoding procedures and decoding procedures are carried out by software, the programs as the software are installed in a general-purpose computer or the like.

Figure 20:
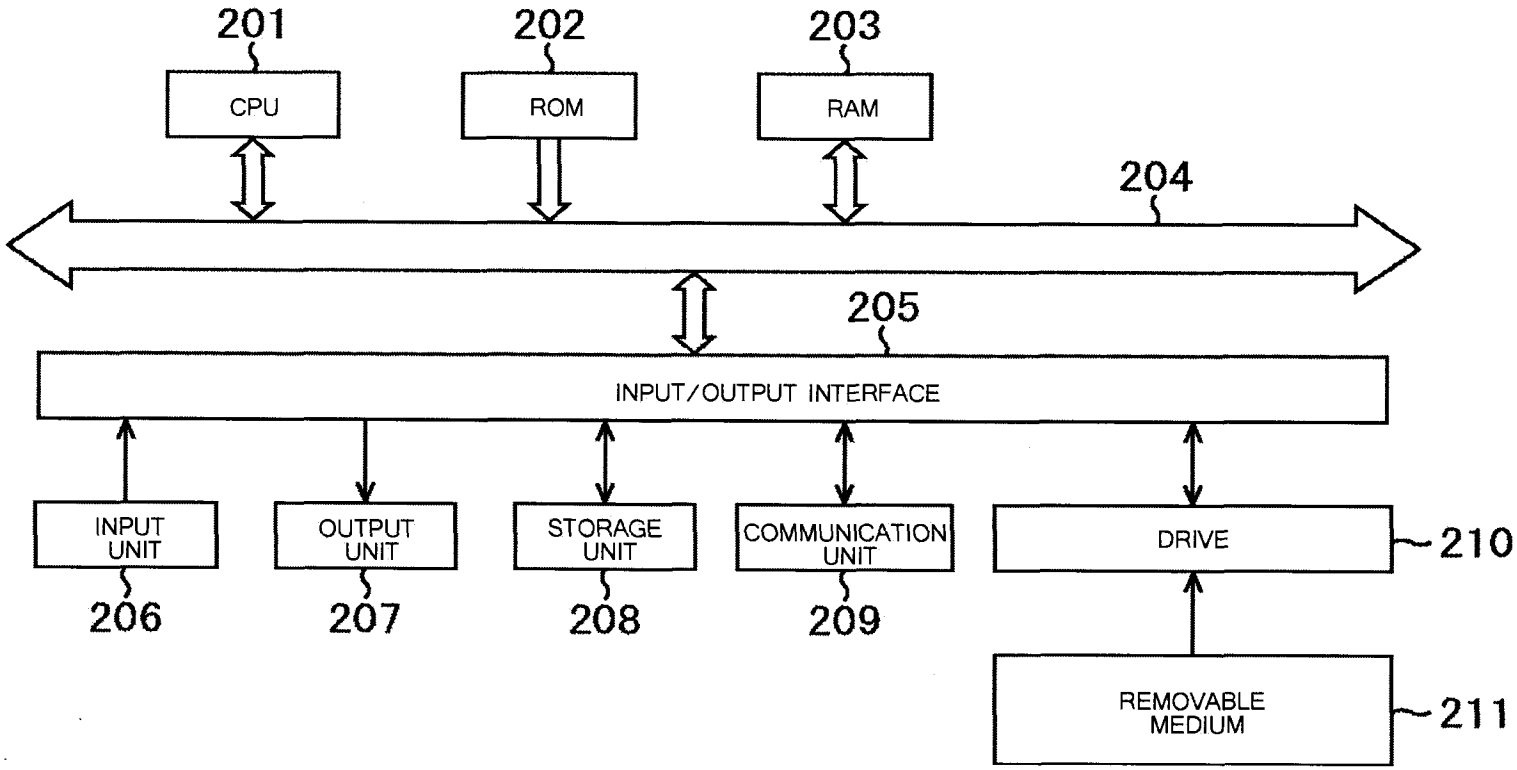
FIG. 20 is a diagram showing an example structure of a computer.

FIG. 20 shows an example structure of an embodiment of the computer in which the programs for carrying out the above described series of procedures are installed.

The programs can be recorded beforehand in a storage unit 208 or a ROM (Read Only Memory) 202 that are provided as recording media in the computer.

Alternatively, the programs may be stored (recorded) in a removable medium 211. This removable medium 211 can be provided as so-called package software. Here, the removable medium 211 may be a flexible disc, a CD-ROM (Compact Disc Read Only Memory), a MO (Magneto Optical) disc, a DVD (Digital Versatile Disc), a magnetic disc, a semiconductor memory, or the like, for example.

The programs are installed in the computer from the above described removable medium 211 via a drive 210. Alternatively, the programs may be downloaded into the computer via a communication network or a broadcast network, and be installed in the internal storage unit 208. That is, the programs can be transferred wirelessly from a download site to the computer via an artificial satellite for digital satellite broadcasting, or can be transferred online to the computer via a network such as a LAN (Local Area Network) or the Internet, for example.

The computer includes a CPU (Central Processing Unit) 201, and an input/output interface 205 is connected to the CPU 201 via a bus 204.

When an instruction is input by a user operating an input unit 206 via the input/output interface 205, the CPU 201 executes a program stored in the ROM 202, in accordance with the instruction. Alternatively, the CPU 201 loads the program from the storage unit 208 into a RAM (Random Access Memory) 203, and then executes the program.

With this arrangement, the CPU 201 performs operations according to the above described flowcharts or performs operations with the structures shown in the above described block diagrams. Via the input/output interface 205, the CPU 201 outputs the results of the operations from an output unit 207, or transmits the results from a communication unit 209, or records the results into the storage unit 208, for example, where necessary.

The input unit 206 is a keyboard, a mouse, a microphone, or the like. The output unit 207 is a LCD (Liquid Crystal Display), a speaker, or the like.

In this specification, procedures to be carried out by the computer in accordance with the programs are not necessarily carried out in chronological order by following the sequences shown in the flowcharts. That is, the procedures to be carried out by the computer in accordance with the programs include procedures to be carried out in parallel or independently of one another (such as parallel processing or processing by objects, for example).

The programs may be executed by a computer (or a processor), or may be executed by two or more computers in a distributed manner. Further, the programs may be transferred to a remote computer, and be executed by the remote computer.

Embodiments of the present invention are not limited to the above described embodiments, and various modifications may be made to them without departing from the scope of the invention.

REFERENCE SIGNS LIST

50 Encoding apparatus
52 Multiplexing unit
61 Determining unit
62 Extracting unit

63 Normalizing unit
70 Decoding apparatus
71 Dividing unit
73 Higher frequency component generating unit
74 Phase randomizing unit
75 Inverse MDCT unit
100 Decoding apparatus
101 Dividing unit
101 Determining unit

The invention claimed is:

1. A decoding apparatus comprising:

an obtaining unit configured to obtain, as encoding results, a lower frequency envelope of an audio signal, a lower frequency spectrum normalized by using the lower frequency envelope, a higher frequency envelope of the audio signal, and a degree of concentration of a higher frequency spectrum of the audio signal;

a generating unit configured to generate a spectrum by using the normalized lower frequency spectrum and the higher frequency envelope in the encoding results obtained by the obtaining unit;

a randomizing unit configured to randomize a phase of the spectrum, based on the degree of concentration, the spectrum being generated by the generating unit; and a combining unit configured to denormalize the lower frequency spectrum by using the lower frequency envelope in the encoding results obtained by the obtaining unit, and combine the spectrum randomized by the randomizing unit or the spectrum generated by the generating unit with the denormalized lower frequency spectrum, a result of the combination being used as a spectrum of an entire band.

2. The decoding apparatus according to claim 1, wherein when the degree of concentration is higher than a predetermined threshold value, the randomizing unit does not randomize the phase of the spectrum generated by the generating unit, and when the degree of concentration is equal to or lower than the predetermined threshold value, the randomizing unit randomizes the phase of the spectrum generated by the generating unit.

3. The decoding apparatus according to claim 1, wherein the obtaining unit obtains a random flag, the random flag being information indicating whether the randomizing unit is to perform randomization, the random flag being determined based on the lower frequency envelope, the lower frequency spectrum, the higher frequency envelope, and the degree of concentration, when the random flag is information indicating that the randomization is to be performed, the randomizing unit randomizes the phase of the spectrum and supplies the randomized spectrum to the combining unit, and when the random flag is information indicating that the randomization is not to be performed, the randomizing unit does not randomize the phase of the spectrum and supplies the spectrum to the combining unit.

4. A decoding method implemented in a decoding apparatus, the decoding method comprising:

an obtaining step of obtaining, as encoding results, a lower frequency envelope of an audio signal, a lower frequency spectrum normalized by using the lower frequency envelope, a higher frequency envelope of the audio signal, and a degree of concentration of a higher frequency spectrum of the audio signal;

a generating step of generating a spectrum by using the normalized lower frequency spectrum and the higher frequency envelope in the encoding results obtained in the obtaining step;

a randomizing step of randomizing a phase of the spectrum, based on the degree of concentration, the spectrum being generated in the generating step; and a combining step of denormalizing the lower frequency spectrum by using the lower frequency envelope in the encoding results obtained in the obtaining step, and combining the spectrum randomized in the randomizing step or the spectrum generated in the generating step with the denormalized lower frequency spectrum, a result of the combination being used as a spectrum of an entire band.

5. A non-transitory computer-readable storage medium storing a program which, when executed by a computer, causes the computer to perform an operation comprising:

an obtaining step of obtaining, as encoding results, a lower frequency envelope of an audio signal, a lower frequency spectrum normalized by using the lower frequency envelope, a higher frequency envelope of the audio signal, and a degree of concentration of a higher frequency spectrum of the audio signal;

a generating step of generating a spectrum by using the normalized lower frequency spectrum and the higher frequency envelope in the encoding results obtained in the obtaining step;

a randomizing step of randomizing a phase of the spectrum, based on the degree of concentration, the spectrum being generated in the generating step; and a combining step of denormalizing the lower frequency spectrum by using the lower frequency envelope in the encoding results obtained in the obtaining step, and combining the spectrum randomized in the randomizing step or the spectrum generated in the generating step with the denormalized lower frequency spectrum, a result of the combination being used as a spectrum of an entire band.

6. A decoding apparatus comprising:

an obtaining unit configured to obtain, as encoding results, a lower frequency envelope of an audio signal, a lower frequency spectrum normalized by using the lower frequency envelope, and a higher frequency envelope of the audio signal;

a generating unit configured to generate a spectrum by using the normalized lower frequency spectrum and the higher frequency envelope in the encoding results obtained by the obtaining unit;

a determining unit configured to determine a degree of concentration of the lower frequency spectrum, based on the normalized lower frequency spectrum in the encoding results obtained by the obtaining unit;

a randomizing unit configured to randomize a phase of the spectrum, based on the degree of concentration determined by the determining unit, the spectrum being generated by the generating unit; and a combining unit configured to denormalize the lower frequency spectrum by using the lower frequency envelope in the encoding results obtained by the obtaining unit, and combine the spectrum randomized by the randomizing unit or the spectrum generated by the generating unit with the denormalized lower frequency spectrum, a result of the combination being used as a spectrum of an entire band.

7. The decoding apparatus according to claim 6, wherein when the degree of concentration is higher than a predetermined threshold value, the randomizing unit does not randomize the phase of the spectrum generated by the generating unit, and when the degree of concentration is equal to or lower than the predetermined threshold value, the randomizing unit randomizes the phase of the spectrum generated by the generating unit.

8. The decoding apparatus according to claim 6, wherein when the degree of concentration of the lower frequency spectrum is higher than a predetermined threshold value, the determining unit determines a random flag to be information indicating that the randomizing unit is not to perform randomization, the random flag being information indicating whether the randomizing unit is to perform the randomization, when the degree of concentration of the lower frequency spectrum is equal to or lower than the predetermined threshold value, the determining unit determines the random flag to be information indicating that the randomizing unit is to perform the randomization, when the random flag is the information indicating that the randomization is to be performed, the randomizing unit randomizes the phase of the spectrum and supplies the randomized spectrum to the combining unit, and when the random flag is the information indicating that the randomization is not to be performed, the randomizing unit does not randomize the phase of the spectrum and supplies the spectrum to the combining unit.

9. A decoding method implemented in a decoding apparatus, the decoding method comprising:

an obtaining step of obtaining, as encoding results, a lower frequency envelope of an audio signal, a lower frequency spectrum normalized by using the lower frequency envelope, and a higher frequency envelope of the audio signal;

a generating step of generating a spectrum by using the normalized lower frequency spectrum and the higher frequency envelope in the encoding results obtained in the obtaining step;

a determining step of determining a degree of concentration of the lower frequency spectrum, based on the normalized lower frequency spectrum in the encoding results obtained in the obtaining step;

a randomizing step of randomizing a phase of the spectrum, based on the degree of concentration determined in the determining step, the spectrum being generated in the generating step; and a combining step of denormalizing the lower frequency spectrum by using the lower frequency envelope in the encoding results obtained in the obtaining step, and combining the spectrum randomized in the randomizing step or the spectrum generated in the generating step with the denormalized lower frequency spectrum, a result of the combination being used as a spectrum of an entire band.

10. A non-transitory computer-readable storage medium storing a program which, when executed by a computer, causes the computer to perform an operation comprising:

an obtaining step of obtaining, as encoding results, a lower frequency envelope of an audio signal, a lower frequency spectrum normalized by using the lower frequency envelope, and a higher frequency envelope of the audio signal;

a generating step of generating a spectrum by using the normalized lower frequency spectrum and the higher frequency envelope in the encoding results obtained in the obtaining step;

a determining step of determining a degree of concentration of the lower frequency spectrum, based on the normalized lower frequency spectrum in the encoding results obtained in the obtaining step;

a randomizing step of randomizing a phase of the spectrum, based on the degree of concentration determined in the determining step, the spectrum being generated in the generating step; and a combining step of denormalizing the lower frequency spectrum by using the lower frequency envelope in the encoding results obtained in the obtaining step, and combining the spectrum randomized in the randomizing step or the spectrum generated in the generating step with the denormalized lower frequency spectrum, a result of the combination being used as a spectrum of an entire band.

11. An encoding apparatus comprising:

a determining unit configured to determine a degree of concentration of a higher frequency spectrum of an audio signal, based on the higher frequency spectrum;

an extracting unit configured to extract an envelope of a lower frequency spectrum and an envelope of the higher frequency spectrum from a spectrum of the audio signal;

a normalizing unit configured to normalize the lower frequency spectrum by using the envelope of the lower frequency spectrum; and a multiplexing unit configured to obtain encoding results by multiplexing the degree of concentration determined by the determining unit, the envelope of the lower frequency spectrum and the envelope of the higher frequency spectrum extracted by the extracting unit, and the lower frequency spectrum normalized by the normalizing unit.

12. The encoding apparatus according to claim 11, wherein when the degree of concentration is higher than a predetermined threshold value, the concentration degree determining unit further determines a random flag to be information indicating randomization is not to be performed, the random flag being information indicating whether a decoding apparatus decoding the encoding results is to randomize a predetermined spectrum when generating the predetermined spectrum as the higher frequency spectrum, when the degree of concentration is equal to or lower than the predetermined threshold value, the determining unit determines the random flag to be information indicating that the randomization is to be performed, and the multiplexing unit obtains the encoding results by multiplexing the random flag, the envelope of the lower frequency spectrum, the envelope of the higher frequency spectrum, and the normalized lower frequency spectrum.

13. An encoding method implemented in an encoding apparatus, the encoding method comprising:

a determining step of determining a degree of concentration of a higher frequency spectrum of an audio signal, based on the higher frequency spectrum;

an extracting step of extracting an envelope of a lower frequency spectrum and an envelope of the higher frequency spectrum from a spectrum of the audio signal;

a normalizing step of normalizing the lower frequency spectrum by using the envelope of the lower frequency spectrum; and a multiplexing step of obtaining encoding results by multiplexing the degree of concentration determined in the determining step, the envelope of the lower frequency spectrum and the envelope of the higher frequency spectrum extracted in the extracting step, and the lower frequency spectrum normalized in the normalizing step.

14. A non-transitory computer-readable storage medium storing a program which, when executed by a computer, causes the computer to perform an operation comprising:

a determining step of determining a degree of concentration of a higher frequency spectrum of an audio signal, based on the higher frequency spectrum;

an extracting step of extracting an envelope of a lower frequency spectrum and an envelope of the higher frequency spectrum from a spectrum of the audio signal;

a normalizing step of normalizing the lower frequency spectrum by using the envelope of the lower frequency spectrum; and a multiplexing step of obtaining encoding results by multiplexing the degree of concentration determined in the determining step, the envelope of the lower frequency spectrum and the envelope of the higher frequency spectrum extracted in the extracting step, and the lower frequency spectrum normalized in the normalizing step.

* * * * *